United States Patent [19]

Goto et al.

[11] Patent Number: 5,066,979

[45] Date of Patent: Nov. 19, 1991

[54] COLOR IMAGE FORMING APPARATUS WHEREIN PLURAL COLORS CAN BE FORMED THROUGH ONE PRINTING CYCLE

[75] Inventors: Masahiro Goto, Kawasaki; Takahiro Inoue, Yokohama; Junichi Kato, Sagamihara; Tatsuya Kobayashi, Tokyo, all of Japan

[73] Assignee: Canon Kabushiki Kaisha, Tokyo, Japan

[21] Appl. No.: 463,443

[22] Filed: Jan. 11, 1990

[30] Foreign Application Priority Data

Jan. 13, 1989 [JP] Japan ..... 1-004760
May 9, 1989 [JP] Japan ..... 1-115532

[51] Int. Cl.[5] ..... G03G 15/01

[52] U.S. Cl. ..... 355/208; 355/245; 355/326

[58] Field of Search ..... 355/208, 246, 265, 326, 355/328, 251; 346/157; 118/645

[56] References Cited

U.S. PATENT DOCUMENTS 4,337,306 6/1982 Kanbe et al. ..... 430/122
4,349,268 9/1982 Hirata ..... 355/328
4,416,533 11/1983 Tokunaga et al. ..... 346/160
4,572,651 2/1986 Komatsu et al. ..... 355/244
4,660,961 4/1987 Kuramoto et al. ..... 355/202
4,797,335 1/1989 Hiratsuka et al. ..... 355/265 X
4,887,102 12/1989 Yoshikawa et al. ..... 346/157

FOREIGN PATENT DOCUMENTS 56-12650 2/1981 Japan .
56-144452 11/1981 Japan .
61-190354 8/1986 Japan ..... 355/326
63-210861 9/1988 Japan .
1-219773 9/1989 Japan .

*Primary Examiner*—Joan H. Pendegrass
*Attorney, Agent, or Firm*—Fitzpatrick, Cella, Harper & Scinto

[57] ABSTRACT

An image forming apparatus is provided with a latent image forming member for forming first and second electrostatic latent images on an image bearing member. A first developer forms a first visualized image by developing the first electrostatic latent image, and a second developer provides a second visualized image by developing the second electrostatic latent image. The second developer acts on the image bearing member after the first visualized image is formed on the image bearing member, and the second developer includes a developer carrier for carrying a developer to a developing position where the developer is supplied to the image bearing member. A vibratory voltage is applied to the developer carrier of the second developer. A controller changes a duty ratio of the vibratory voltage. The vibratory voltage has a first peak for forming an electric field to urge the developer away from the developing carrier toward the image bearing member and a second peak for forming an electric field to urge the developer away from the image bearing member toward the developer carrier. The first peak and second peak are alternately applied, and the controller changes a duty ratio while maintaining the second peak substantially constant. Furthermore, the controller changes the duty ratio by changing the first peak.

28 Claims, 15 Drawing Sheets

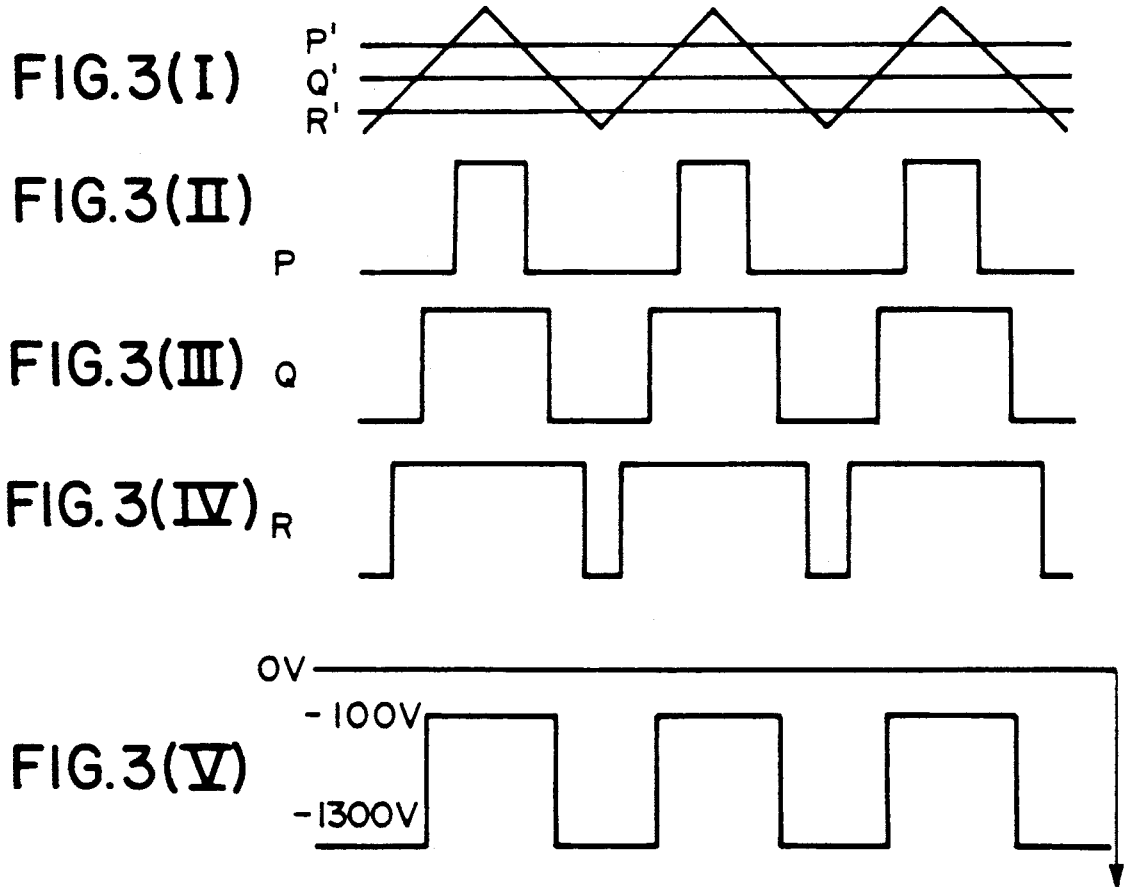
FIG.3(I)
P'
Q'
R'
FIG.3(II)
P
FIG.3(III)
Q
FIG.3(IV)
R
FIG.3(V)
0V
-100V
-1300V FIG.4(III)
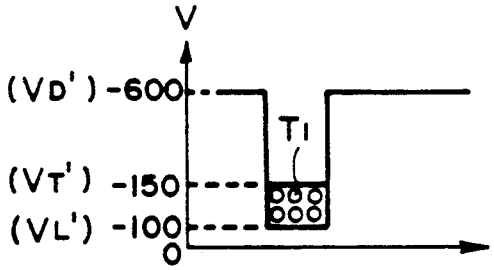

COLOR IMAGE FORMING APPARATUS WHEREIN PLURAL COLORS CAN BE FORMED THROUGH ONE PRINTING CYCLE

FIELD OF THE INVENTION AND RELATED ART

The present invention relates generally to an image forming apparatus, more particularly to a color image forming apparatus such as an electrophotographic copying machine, a printer or a compound recording apparatus, wherein a visible image having plural colors can be formed through a one printing cycle.

In order to develop latent images in plural colors through one printing cycle, a plurality of developing devices are disposed adjacent to an outer periphery of an image bearing member, that is, a photosensitive drum to transfer simultaneously the plural color images onto a transfer material. In such a color image forming apparatus, various proposals have been made as to methods for preventing the visualized image provided by an upstream developing device from being disturbed by being ribbing with the developer of the downstream developing device, with respect to the rotational directions of the photosensitive drum.

For example, U.S. Pat. Nos. 4,572,651 and 4,416,533 propose that developing bias voltages having only DC components are applied to the two developing devices to develop the images with the developers contained in the developing devices.

Japanese Laid-Open Patent Application No. 12650/1981 proposes that a developing bias voltage having only a DC component is applied to the downstream developing device, and the visualized image is formed without contact of the developer to the outer surface of the photosensitive drum.

Japanese Laid-Open Patent Application No. 144452/1981 and U.S. Pat. No. 4,349,268 propose that a developing bias voltage is applied to the downstream developing device, and the visualized image is formed without contact of the developer to the outer surface of the photosensitive drum.

U.S. Pat. No. 4,660,961 proposes that before the electrostatic latent image to be developed by the downstream developing device is formed, a potential level of the image visualized by the upstream developing device is increased.

In an image forming apparatus wherein a downstream developing device acts on the photosensitive drum carrying a visualized image provided by the upstream developing device to form an additional visualized image, there is a liability that the developer constituting visualized image provided by the upstream developing device is introduced into the downstream developing device, and the mixture develops the second electrostatic latent image by the downstream developing device, thus deteriorating the image quality.

These problems are particularly remarkable when the charging polarity of the developer in the upstream developing device and that of the downstream developing device are the same.

Japanese Laid-Open, Patent Application No. 210861/1988 (U.S. Pat. No. 4,887,102) and Japanese Laid-Open Patent Application No. 219773/1989 propose an image forming apparatus, wherein a developing bias voltage having an AC component is applied to the downstream developing device, and wherein the above problems are solved. However, even if the requirements disclosed in the Japanese Laid-Open Patent Applications are satisfied, it is difficult to adjust in good order an image density and a line width of a line image. It is known, for example, that an alternating bias voltage provided by superposing an AC voltage and a DC voltage is applied as a developing bias to the developer carrying member, wherein the DC voltage level is automatically or manually changed to shift the bias voltage level so as to change the developed image contrast level, thus adjusting the image (U.S. Pat. No. 4,337,306). If this is used with a plural color image forming apparatus, another problem arises.

Referring to FIG. 1, the mechanism of the problem will be described. FIG. 1 shows a relation between the AC voltage component and the DC voltage component of the developing bias applied to the downstream developing device, wherein the ordinate represents a DC voltage component (Vdc), and the abscissa represents a peak-to-peak voltage (Vpp) of the AC component.

A line A represents the requirement for preventing production of a foggy background, and a chain line B represents a requirement for preventing toner mixture. Those lines were determined on the basis of experimental data the (frequency of the developing bias was 1600 Hz, the potential of the latent image was the same as in the embodiment which will be described hereinafter, and the distance d between the developing sleeve and the photosensitive member was 300 microns).

As will be understood from this figure, the region below the line A and above the line B, that is, the hatched area, is an optimum area wherein the two requirements are satisfied.

When the line width adjusting range exceeds $\pm 50$ microns, the range $\Delta V$ of the DC component Vdc has not been much dependent on the peak-to-peak voltage Vpp, and 200 V has been required.

As a result, in order to permit sufficient adjustment as to the prevention of the foggy background, the prevention of the toner from mixing into the downstream developing device and as to the line width, the peak-to-peak voltage Vpp is required to be not more than 850, as shown in FIG. 1.

However, if the peak-to-peak voltage Vpp is low, it becomes difficult to provide sufficient image density in the downstream developing device.

For example, when an image was produced with the peak-to-peak voltage Vpp being 800 V, the reproducibility of a thin line becomes very poor when the image density is 1.0.

The image density, here, was measured from a solid image of 5 mm square using a reflection density measuring device available from McBeth under the name of RD 514, for example. The line width, here, was measured from two dot line printed with five dot space in 300 DPI, using a line width measuring device, available from Konishiroku Shashin Kogyo Kabushiki Kaisha, Japan, under the name of FBD line density measuring device.

Even in an apparatus wherein the DC voltage is set in a plant, considering the sensitivity characteristics of the photosensitive member, the characteristics of the charger and the characteristics of the illumination source for illuminating an original, the AC voltage has a duty ratio of 1:1, and the DC voltage component is adjusted, as disclosed in the Japanese Laid-Open Application, the adjustable range is narrow, and in addition, when the voltage of the voltage source varies, the image quality is easily deteriorated, and the developer is easily mixed into the downstream developing device.

SUMMARY OF THE INVENTION

Accordingly, it is a principal object of the present invention to provide an image forming apparatus, wherein a developer of a first developing device is prevented from mixing into a second developing device.

It is another object of the present invention to provide an image forming apparatus wherein the developer of a first developing device is prevented from mixing into a second developing device, and the image quality provided by the second developing device can be adjusted in a wide range.

These and other objects, features and advantages of the present invention will become more apparent upon a consideration of the following description of the preferred embodiments of the present invention taken in conjunction with the accompanying drawings.

According to one aspect of the invention, an image forming apparatus is provided with a latent image forming member for forming first and second electrostatic latent images on an image bearing member. A first developing means forms a first visualized image by developing the first electrostatic latent image, and a second developing means provides a second visualized image by developing the second electrostatic latent image. The second developing means acts on the image bearing member after the first visualized image is formed on the image bearing member. The second developing means includes developer carrying means for carrying the developer to a developing position where the developer is supplied to the image bearing member. A means applies a vibratory voltage to the developer carrying means if the second developing means. A control means changes a duty ratio of the vibratory voltage. The vibratory voltage has a first peak for forming an electric field to urge the developer away from the image bearing member and a second peak for forming an electric field to urge the developer carrying means. The first and second peaks are alternately applied, and the controlling means changes a duty ratio while maintaining the second peak substantially constant. Additionally, the controlling means changes the duty ratio by changing the first peak.

According to a further aspect of the present invention, the control means changes the duty ratio while maintaining an integration value of the vibratory voltage substantially constant.

According to still a further aspect of the present invention, a detecting means is provided for detecting a potential of the first latent image. The control means changes the second peak in accordance with an output of the detecting means.

According to another aspect of the present invention, a latent image potential detecting means is provided for detecting a potential of such a portion of the second latent image as to be visualized. The control means changes an integration value of the vibratory voltage in accordance with an output of the latent image potential detecting means.

According to still yet another aspect of the present invention, an image forming apparatus is provided with a first charger for electrically charging an image bearing member having a predetermined polarity. A first exposure means exposes the image bearing member charged by the first charger with first image information light to form a first electrostatic latent image. A first developing means develops the electrostatic latent image of a first color toner electrically charged to form a first visualized image. A second charger electrically charges the image bearing member having the first visualized image with the same polarity. A second exposure means exposes the image bearing member charged by the second charger with second light information to form a second electrostatic latent image. A second developing means acts on the image bearing member having the first visualized image and the second electrostatic latent image to develop the second latent image to form a second visualized image. The second developing device includes a developer carrying member for carrying a second color toner electrically charged with the same polarity as the first color toner to supply in a developing position the second color toner to the image bearing member. A means applies a vibratory voltage to the developer carrying member of the second developing means. The vibratory voltage has a first peak for forming an electric field to urge the toner away from the developer carrying member toward the image bearing member and a second peak for forming an electric field to urge the toner away from the image bearing towards the developer carrying member. The first peak and the second peak are alternately applied. A control means is provided for changing the duty ratio of the vibratory voltage. An integration value of the vibratory voltage is between a potential of the first visualized image charged by the second charger and a potential of such a portion of the second electrostatic image as to be visualized.

According to an additional aspect of the present invention, an integration value of the vibratory voltage is between a potential of the first visualized image and a potential of such a portion of the second electrostatic latent image as to be visualized.

BRIEF DESCRIPTION OF THE DRAWINGS

FIGS. 3(I)–3(V) show wave forms.

DESCRIPTION OF THE PREFERRED EMBODIMENTS

Figure 2:
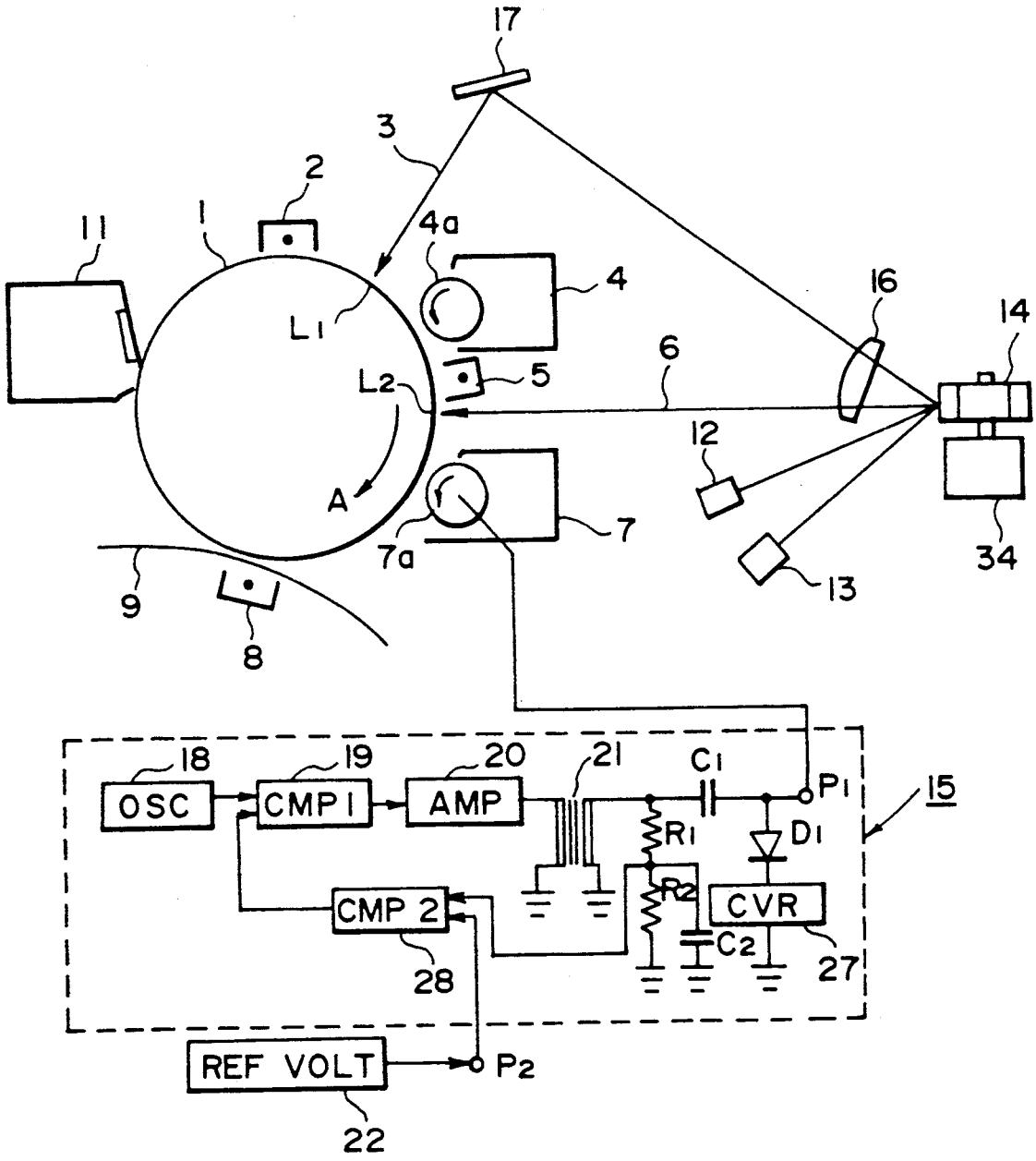
FIG. 2 schematically shows an arrangement of an image forming apparatus according to an embodiment of the present invention.

Referring to FIG. 2, there is shown an image forming apparatus according to an embodiment of the present invention. A main assembly of the image forming apparatus includes an image bearing member, that is, an electrophotographic photosensitive drum 1 disposed adjacent the center of the main assembly. The photosensitive drum 1 is rotatable in a direction indicated by an arrow A. Adjacent to the outer peripheral surface of the photosensitive drum 1, there are disposed a cleaning device 11, a primary charger 2, a first developer 4 of a contact or non-contact type, a secondary charger 5, a second developing device 7 and a transfer charger 8 at predetermined intervals in the order named from the upstream side to the downstream side with respect to the rotational direction of the photosensitive drum 1. An image exposure means includes a polygonal mirror 14, a polygonal mirror driving motor 34, a semiconductor laser 12, another semiconductor laser 13, an image lens 16 and a reflection mirror 17. The second developing device 7 has a developer carrying member in the form of a rotational sleeve 7*a* in this embodiment, to which a developing bias voltage source 15 is connected. The first developing device 4 also has a rotational sleeve 4*a* to which a known developing bias voltage source (not shown) is connected.

A cleaning device 11 functions to remove the developer remaining on the outer periphery of the photosensitive drum 1. The primary charger 2 acts on the outer peripheral surface of the photosensitive drum 1, after it is cleaned by the cleaning device 11, to uniformly charge the photosensitive drum 1 with a negative voltage of approximately −600 V. The semiconductor laser 12 produces a first laser beam 3 modulated in accordance with a first information signal produced by an unshown controller; and the semiconductor laser 13 produces a second laser beam 6 modulated in accordance with a second information signal produced by the controller; and the beams are separately projected on the photosensitive drum 1.

The polygonal mirror 14, rotated by the motor 34, receives a first laser beam 13 emitted from the semiconductor laser 12 and deflects it to raster-scan the outer peripheral surface of the photosensitive drum 1 at a position indicated by a reference L1 through an imaging lens 16 and a reflection mirror 17. By the application of the laser beam, a first latent image is formed having a surface potential of approximately −100 V (light portion potential) at a portion exposed to the laser beam. The polygonal mirror 14 receives the second laser beam 6 emitted from the semiconductor laser 13 and raster-scans the photosensitive drum 1 at a position L2 through the imaging lens 16, the photosensitive drum 1 having a first visualized image provided by the first developing device 4 and having been uniformly charged to a predetermined potential of a negative polarity by the secondary charger 5. By this, a second electrostatic latent image is formed having a surface potential of approximately −100 V (light portion potential $V_1$) at a portion exposed to the laser beam. The developing sleeve 4*a* of the first developing device 4 carries to a two component developer including red toner negatively charged and magnetic carrier particles of ferrite or the like to a developing position. A developing bias voltage which is a superposed DC voltage component and AC voltage component from a developing bias source (not shown) is applied developing devices of by which the first electrostatic latent image is reverse-developed with the red toner. Thus, the red toner is deposited on the light potential areas of the first latent image exposed to the laser beam 3. The bias voltage applied to the sleeve 4*a* may consists only of the DC component. The secondary charger 5 is effective to uniformly charge again, to a predetermined potential of the negative polarity, the outer peripheral surface of the photosensitive drum on which the visualized image has been formed with the red developer by the first developing device 4. The developing sleeve 7*a* of the second developing device 7 carries to a developing position a one component developer (toner) of black color negatively charged. To the developing sleeve 7*a* of the second developing device 7, a vibratory voltage having alternating maximum level and minimum level from a voltage source which will be described hereinafter, is applied to form a vibratory electric field in the developing position where the developer is transferred from the sleeve 7*a* to the drum 1. The sleeve 7*a* carries a layer of the developer having a thickness smaller than the minimum clearance between the drum 1 and the sleeve 7*a* in the developing position, and the developer transfers to the drum 1 by the vibratory electric field. In this example, the developing device 7 reverse-develops the second latent image. That is, the black toner of the developing device 7 is deposited on the light potential portion of the second latent image which has been exposed to the laser beam 6, by which the latent image is visualized. The second developing device 7 forms the black toner image on the surface of the drum which already have the red toner image provided by the first developing device 4. The two visualized images are transferred at once to a transfer material 9 by the transfer charger 8, and are fixed by an unshown image fixing device.

Figure 1:
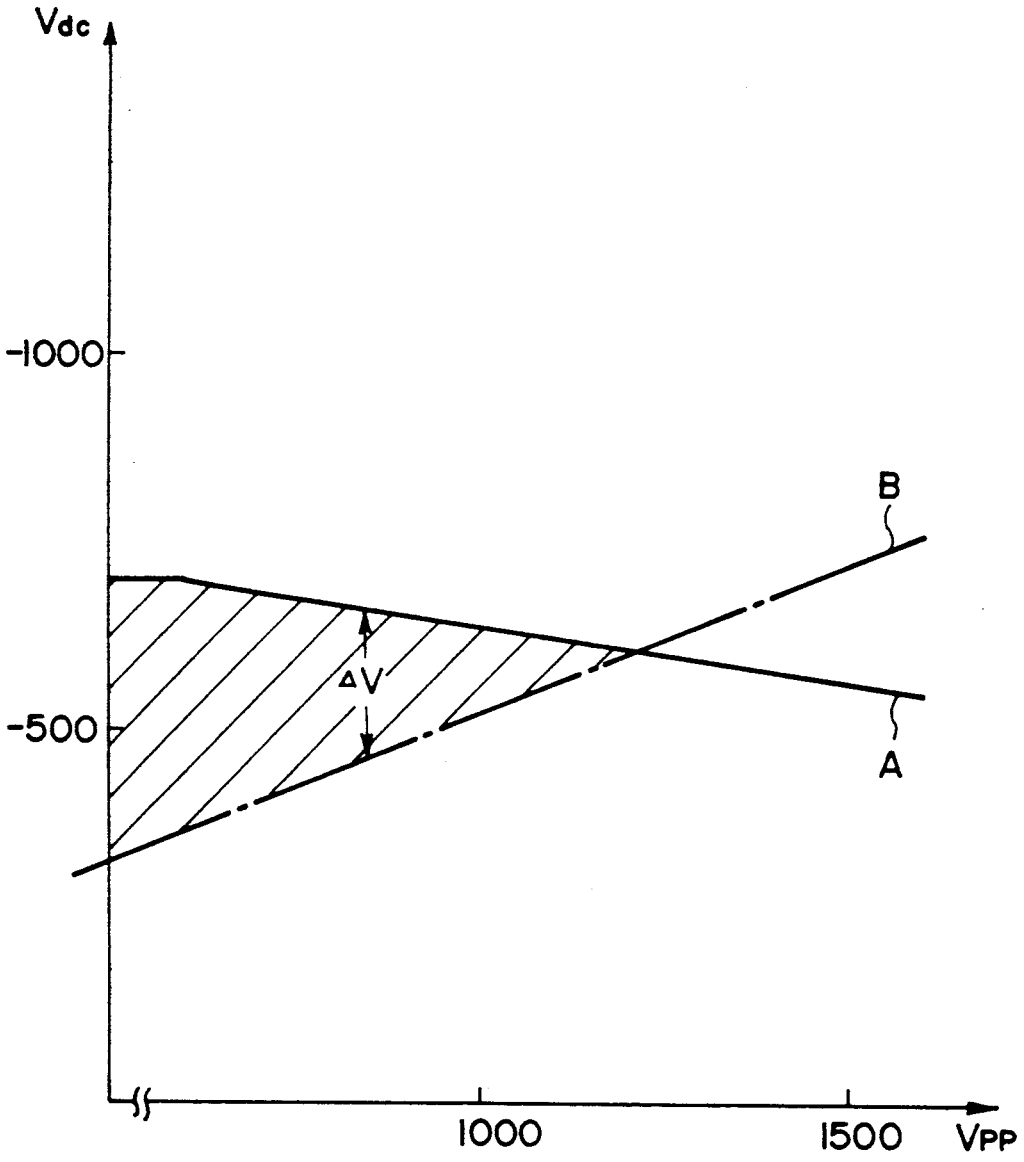
FIG. 1 is a graph showing an optimum image quality adjusting range when a prior art device is used.
Figure 4I:
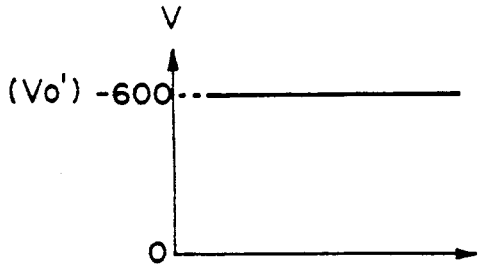
FIGS. 4(I)–4(VI) show surface potential of a photosensitive member.

FIGS 4I–4IV show the surface potential of the photosensitive member 1 in the electrophotographic process shown in FIG. 1. The ordinate represents a negative potential (V), and the abscissa represents a longitudinal (main scanning direction) position on the photosensitive member 1.

Figure 4:
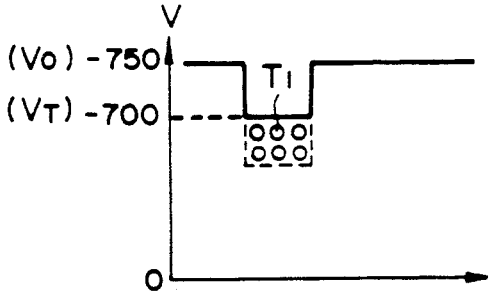
Figure 4:
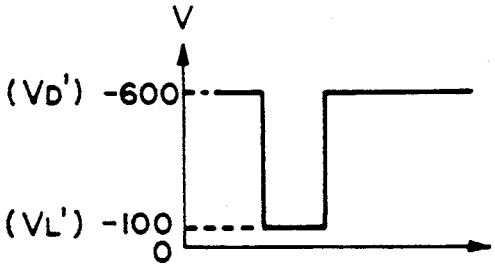
Figure 4V:
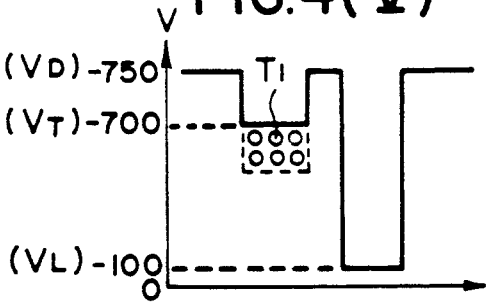
Figure 4:
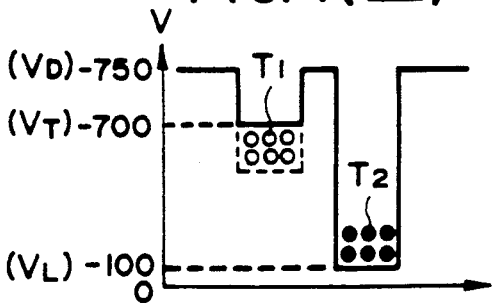

The primary charger 2 charges the photosensitive member 1 to −600 V as shown in FIG. 4(I). By the application of the first laser beam 3, a first electrostatic latent image having a dark portion potential V'D of −600 V and a light portion potential V'L of −100 V. The first developing device 4 develops the first electrostatic latent image, so that a first toner image T1 is formed, as shown in FIG. 4(III). The potential V'T of the first toner image is approximately −150 V. Thereafter, the secondary charger 5 charges the photosensitive member 1, by which the potential VT of the first toner image becomes approximately −700 V, as shown in FIG. 4(IV) Then, the second laser beam 6 is projected, so that as shown in FIG. 4(V), a second electrostatic latent image is formed which has a light portion potential VD of −750 V and a light portion potential VL of approximately −100 V. The second developing device 7 develops the second electrostatic latent image to form the second toner image T2, as shown in FIG. 4(VI). Then, the first and second toner images T1 and T2 are transferred onto the transfer sheet 9 by the transfer charger 8.

Figure 5:
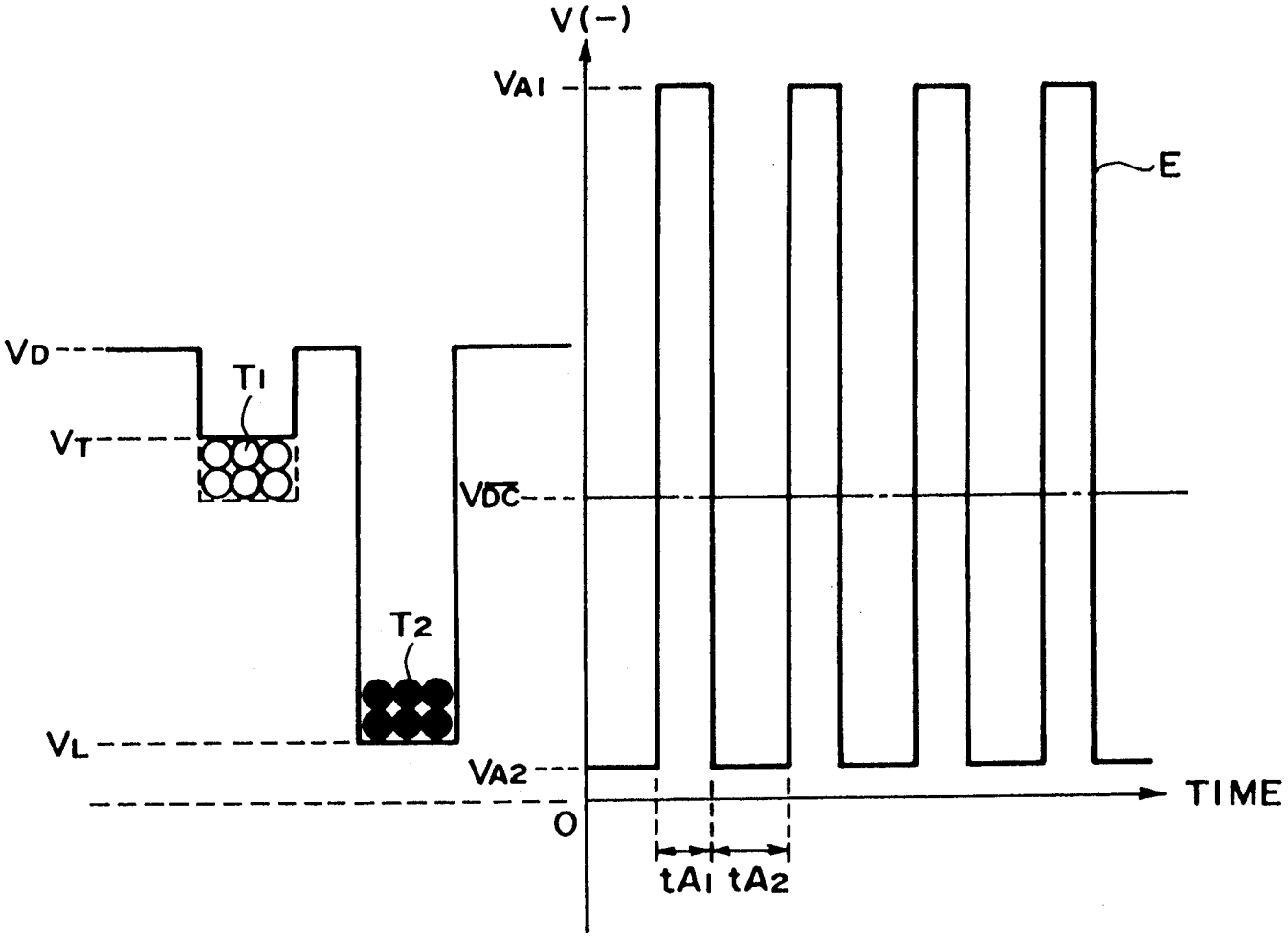
FIG. 5 shows a surface potential of a photosensitive member and a vibrating bias voltage.

To the developing sleeve *7a* of the second developing device 7 an alternating bias voltage E having a variable duty ratio and having a frequency of 1600 Hz, for example, is applied as shown in FIG. 5, and therefore, the first toner image T1 receives two forces. One is the force which is provided by the electric field for moving the negatively charged toner away from the sleeve and toward the photosensitive member and which is proportional to |VA1-VT|. The other is a force which is provided by an electric field for moving the toner away from the photosensitive member toward the sleeve and which is proportional to |VT-VA2|. These forces are applied alternately.

On the other hand, with respect to the second image, the two forces are applied. One is the force provided by the electric field for moving the negatively charged black toner away from the sleeve toward the photosensitive member and which is proportional to |VA-1-VL|. The other is the force which is provided by the electric field for moving the toner away from the photosensitive member toward the sleeve to remove the black toner from the photosensitive member and which is proportional to |VA2-VL|. In the above statements, VA1 and VA2 are the minimum and maximum levels of the bias voltage E, and VT is a potential of the first toner image. In FIG. 5, $\overline{VDC}$ is a time average of the vibratory bias voltage E, that is, a time-integrated level of the vibratory bias voltage is one period ($t_{A1}+t_{A2}$). In the specification, this is called an average or integration of the vibratory bias voltage.

(A) Influence of the minimum level VA1 of the developing bias voltage

As will be understood from the foregoing, the minimum level VA1 of the developing bias voltage is effective to urge the developer to the electrostatic latent image formed on the outer peripheral surface of the photosensitive drum to visualize the latent image. More particularly, the voltage VA1 acts on the red developer forming the first visualized image on the photosensitive drum 1 to urge the red developer to the photosensitive drum 1 in proportion to |VA1-VT|. It acts on the black developer of the second image to urge the black developer to the photosensitive drum 1 in proportion to |VA1-VL|. Therefore, with the increase of |VA1|, the differences |VA1−VT| and |VA1-VL| increase, and therefore, the image density of the developed image increases, and the line width becomes larger. If, however, |VA1| becomes extremely large, the black developer is deposited on the visualized part of the first image or the background (VD in FIG. 4) with the result of the foggy image. In addition, there occurs a liability that electric discharge occurs between the developing sleeve *7a* and the photosensitive drum 1 because the minimum clearance d between the developing sleeve *7a* and the photosensitive drum 1 at the developing position is as small as 300 microns, for example. It is empirically known that the limit of the voltage VA1 to prevent the above is approximately −1500 V for a latent image having VD=−750 V and VL=−100 V, for example.

When, on the other hand, |VA1| becomes small, the density of the developed image lowers, and the line width becomes smaller with the result of an unsharp image with discontinuity. Therefore, it is not preferable that the voltage VA1 is lower than approximately −900 V in the absolute value. Therefore, under the condition that VD=−750 V, VL=−100 V and d=300 microns, the voltage VA1 preferably satisfies −1500 V≦VA1≦−900 V. The influence of the voltage VA1 is dependent on the time period during which the voltage VA1 is applied. This will be described later with respect to $\overline{VDC}$.

(B) Influence of the maximum level VA2 of the developing bias voltage

As will be understood from the foregoing, the maximum level VA2 of the developing bias voltage acts on the developer visualizing the latent image on the photosensitive drum to move it away from the photosensitive drum. That is, the voltage VA2 applies force to the red developer of the first visualized image in the direction away from the photosensitive drum in proportion to |VT-VA2|. It also applies force to the black developer of the second latent image in the direction away from the photosensitive drum in proportion to |VA2-VL|. Therefore, with the reduction of |VA2|, the red developer of the first developed image becomes more mixed into the second developing device 7 with the result of mixture with the black developer. The mixture of the red developer of the first visualized image into the second developing device 7 is dependent on the force proportional to |VA-VA2|, that is, the electric field formed between the developing sleeve *7a* and the photosensitive drum 1. Therefore, |VT-VA2| preferably satisfies:

$$|VT-VA2|/d \leqq 2.25 \text{ [V/micron]} \quad (1)$$

as disclosed in U.S. Pat. No.. ;4,887,102, from the standpoint of preventing the mixture. Then, when VT=−700 V, and the clearance between the developing sleeve *7a* and the photosensitive drum 1 is 300 microns (d), the voltage VA2 has to be not more than −25 V. On the contrary, if the voltage VA2 is too small, a foggy background is produced in the copy image. The above-described influence is dependent on the time during which the voltage VA2 is applied, which will be described in conjunction with $\overline{VDC}$, in the following paragraph.

(C) Influence of time average $\overline{VDC}$ of the developing bias voltage

The time average of the developing bias voltage (rectangular pulse signal E) has the influence similar to the DC component VDC of the developing bias voltage when the pulse duty ratio is 5:5. During the time period $t_{A1}$ in which the minimum voltage VA1 is applied, the black developer in the second developing device moves toward the photosensitive drum 1 surface. As a result, an amount of the black developer which is proportional to $VA1 \times t_{A1}$ is deposited on the outer surface of the photosensitive drum 1. During the time period $t_{A2}$ in which the maximum level VA2 is applied, the black developer forming the second visualized image moves away from the photosensitive drum 1 to the sleeve *7a* of the second developing device 7. As a result, an amount of the black developer proportional to $VA2 \times t_{A2}$ is returned into the second developing device 7. Therefore, this is equivalent to when an asymmetrical vibrating electric field having a center of $\overline{VDC} = [(VA1 \times t_{A1}) + (VA2 \times t_{A2})]/(t_{A1}+t_{A2})$ is applied between the photosensitive drum 1 and the sleeve *7a*. The voltage $\overline{VDC}$ is set between the voltages VD and VL. However, if the difference between $|VD|$ and $|V\overline{DC}|$ is smaller than 50 V, the foggy background is produced by the above-described developing action and if the difference is larger than 250 V, a reverse foggy background is produced by the developer through reverse development.

Therefore, the image density of the developed image, and the line width can be increased without the above described problems, by changing the voltage $V\overline{DC}$ within the range $50\ V \leqq |VD| - |V\overline{DC}| \leqq 250\ V$ so that $|V\overline{DC}| - |L|$ is larger. From the standpoint of preventing the black toner deposition on the first toner image T1, it is preferable that $V\overline{DC}$ is between VT and VL.

As described in the foregoing, VA1, VA2 and $V\overline{DC}$ have respective preferable ranges because of the image density, line width, sharpness, mixture in color, foggy background production or the like of the copy image. For example, when $VD = -750$ V; $VL = -100$ V; $VT = -700$ V; and $d = 300$ microns, $$-1500\ V \leqq VA1 \leqq -900\ V,$$

$$VA2, \leqq -25\ V,$$

$$-700\ V \leqq V\overline{DC} \leqq -500\ V.$$

Generally speaking, VA1, VA2 and $V\overline{DC}$ are preferably selected so as to satisfy the following:

(1) In the case wherein the charging polarity of the first charger 2 and that of the second charger 5 relative to the photosensitive member are negative, and the charge polarity of the toner used in the first developing device 4, and that in the second developing device 7 are negative:

The image portion potential VL of the second latent image:

$$|VA1 - VL|/d \geqq 2.65\ (V/micron) \quad (1)$$

Image portion potential VT of the first toner image:

$$|VA2 - VT|/d \leqq 2.25\ (V/micron) \quad (2)$$

The integration VDC of the vibratory bias voltage E:

$$|VL| + 100 \leqq |V\overline{DC}| \leqq |VD| - 50\ (V) \quad (3)$$

The requirement of equation (1) improves the image density and reproducibility of a thin line; (2) improves prevention of the mixture of the first toner into the second developing device 7; and (3) improves the image density and the line width.

(2) In the case wherein the charging polarity of the first charger 2 and that of the second charger 5 relative to the photosensitive member are positive, and the charging polarity of the toner particles used in the first developing device 4 and the second developing device 7:

Image portion potential VL of the second latent image:

$$|VA2 - VL|/d \geqq 2.65\ (V/micron) \quad (4)$$

The image portion potential VT of the first toner image:

$$|VA1 - VT|/d \leqq 2.25\ (V/micron) \quad (5)$$

The integration $V\overline{DC}$ of the vibratory bias voltage E:

$$|VL| + 100 \leqq |V\overline{DC}| \leqq |VD| - 50\ (V) \quad (6)$$

The requirement (4) improves the image density and the reproducibility of a thin line; the requirement (5) improves the mixture of the first toner into the second developing device 7; and (6) improves the image density and the line width.

Figure 6A:
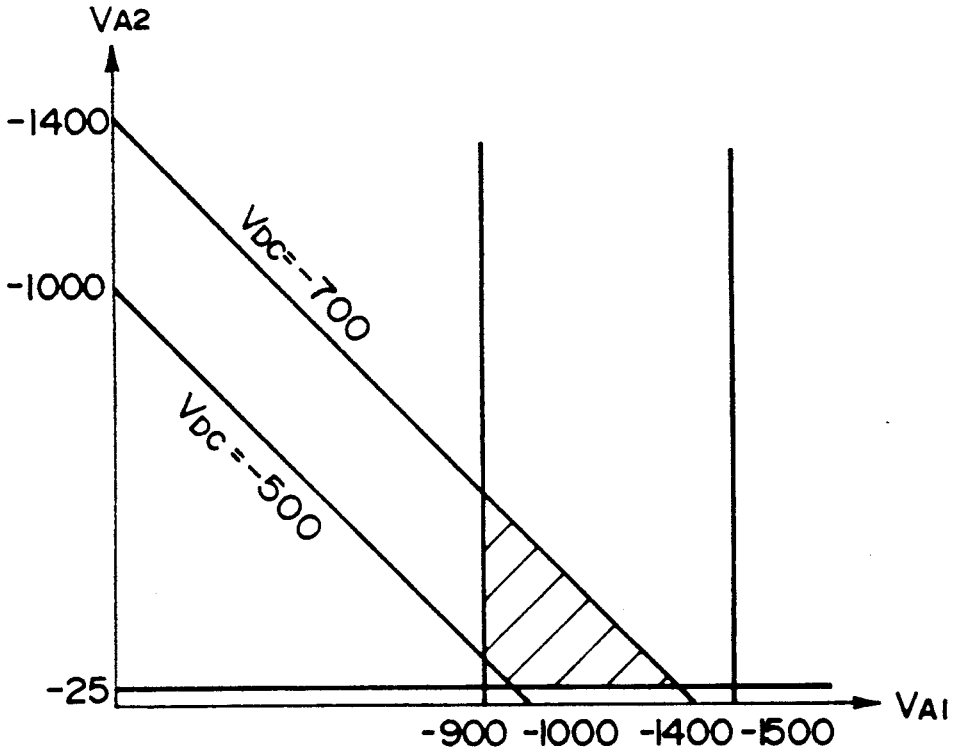
FIG. 6A is a graph showing an adjustable range between maximum and minimum levels providing an optimum image quality using prior art.
Figure 6B:
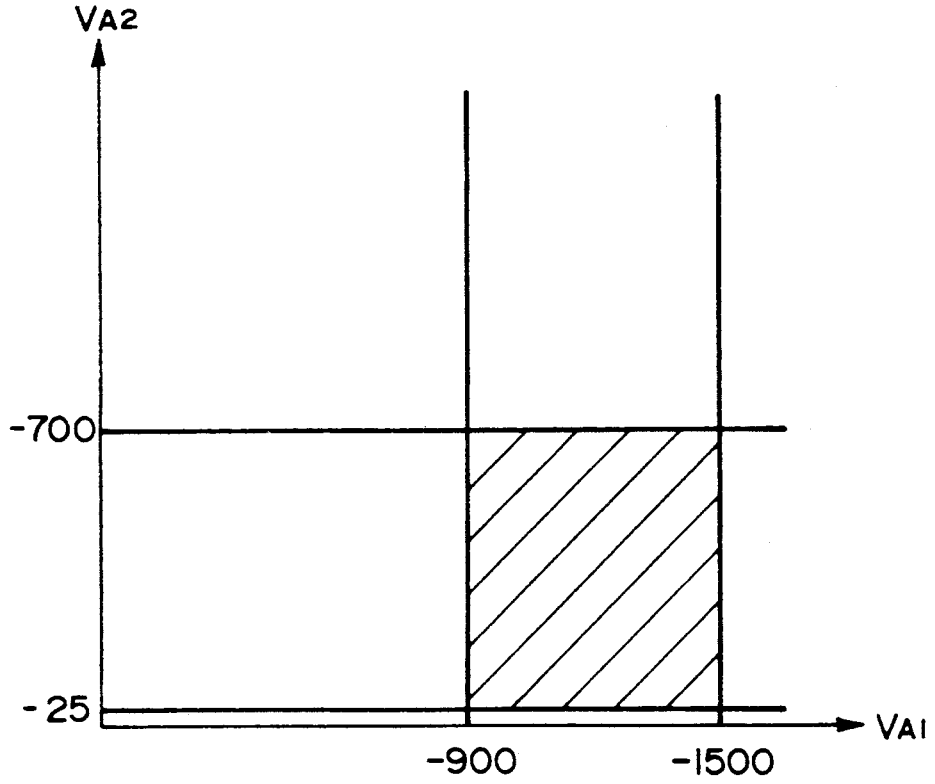
FIG. 6B shows the same when the present invention is used.

FIG. 6A shows the ranges of the voltages VA1 and VA2 which satisfy the various requirements relating to the image density, line width, sharpness, toner mixture and fog prevention of the copy image when the duty ratio of the developing bias voltage applied to the developing sleeve 7a is fixed to be 5:5. FIG. 6B shows regions of VA1 and VA2 satisfying the various requirements when the duty ratio of the developing bias voltage applied to the developing sleeve 7a is changed. In FIGS. 6A and 6B, the regions are indicated as hatched areas. The changes in the surface potentials VD and VL or the like on the surface of the photosensitive drum 1 result from changes in the ambient conditions under which the image forming apparatus of this embodiment is placed or changes in the charging conditions for the photosensitive drum 1. When those factors are taken into account, the above regions are further narrowed, and the practical region is smaller than the hatched regions by approximately 100 V. As shown in FIG. 6A, when the duty ratio of the developing bias voltage is fixed to be 5:5, the above set region becomes very narrow. However, as in this embodiment, when the voltage VA2 is retained at a predetermined level, and the variation of the voltage VA1 is compensated by changing the pulse duty ratio by a feed back control to provide a constant $V\overline{DC}$, an image having constant image density and line width and having good sharpness without toner mixture and without foggy background, can be stably provided within a wide range of conditions.

In this specification, "duty ratio" means a ratio between the time of one period in which a voltage higher than a middle of the vibratory voltage between the maximum level and the minimum level, that is, ((maximum voltage)+(minimum voltage))/2 continues and the time of one period in which a voltage smaller than that continues. For example, in FIG. 4, the waveform is rectangular, and therefore, the duty ratio is $t_{A1}:t_{A2}$.

Referring back to FIG. 2, the developing bias voltage source 15 includes an oscillator 18, a comparator 19 having a function of wave reformer (particularly a slicer), a comparator (differential amplifier) 28, an amplifier 20, a transformer 21, capacitors C1 and C2, resistors R1 and R2, a crumpling diode D1, a constant voltage source 27, an output terminal P1 and input terminal P2. The oscillator 18 produces a triangular pulse signal in the form shown in FIG. 3 (I). The comparator 19 reads the triangular pulse signal produced by the oscillator 18, and also reads an error voltage level signal produced by the comparator 28. The comparator 19 compares the triangular pulse signal and the error voltage level signal, and produces a triangular pulse signal having an on-time period (that is, pulse duty ratio) corresponding to the result of the comparison. When the error voltage level signal produced by the comparator 28 is as indicated by a reference P' in FIG. 3 (I), the comparator 19 produces a rectangular pulse signal P having the on-time width (pulse duty ratio) shown in FIG. 3 (II). When the error voltage level signal produced by the comparator 28 is as indicated by a reference Q', a rectangular pulse signal Q having the on-time width (pulse duty ratio) shown in FIG. 3 (III) is produced. When the error voltage level signal produced by the comparator 28 is as indicated by a reference R', a rectangular pulse signal R having the on-time width (pulse duty ratio) shown in FIG. 3 (IV) is produced. The amplifier 20 receives the rectangular pulse signal P (Q or R) produced by the comparator 19 and amplifies it. The transformer 21 receives the rectangular pulse signal P (Q or R) amplified by the amplifier 20 and increases the signal in the voltage. The capacitor C1 receives the output signal from the transformer 21 and clamps it. The cramping diode D1 and the constant voltage source 27 receives the voltage signal cramped by the capacitor C1 and adds thereto a bias to a negative side, and produces a rectangular pulse signal having a maximum level VA2= −100 V minimum level VA1=−1300 V, and in addition, it applies the rectangular wave pulse signal through the output terminal P1 to between the photosensitive drum 1 and the developing sleeve *7a*. The resistors R1 and R2 constitute a voltage dividing circuit. The capacitor C1 functions as a smoothing capacitor. The voltage dividing circuit and the capacitor C2 receive the output voltage signal from the transformer 21 and smoothes it and divides it in the voltage, and then the voltage drop across the resistor R2 is supplied to the comparator 28. The comparator 28 compares the voltage drop across the resistor R2 and a reference voltage signal corresponding to the target integration applied from the reference voltage source 22 to the input terminal P2, and in response to the result of the comparison (the difference between the actually output the integration and the target integration), and the comparator 28 produces an error voltage level signal shown by references P', Q' and R' in FIG. 3 (I). With such a structure, the maximum level VA2 of the developing bias voltage produced from the output terminal T1 is maintained substantially constantly at −100 V, that is, the constant level determined by the constant voltage circuit 27. Since the output of the comparator 17 is fed back through the comparator 19, the amplifier 20, the transformer 21, a dividing circuit 24', the comparator 28 or the like, the integration $\overline{VDC}$ of the developing bias voltage is substantially maintained constant at a level determined by the reference voltage applied to the terminal P2.

Figure 7:
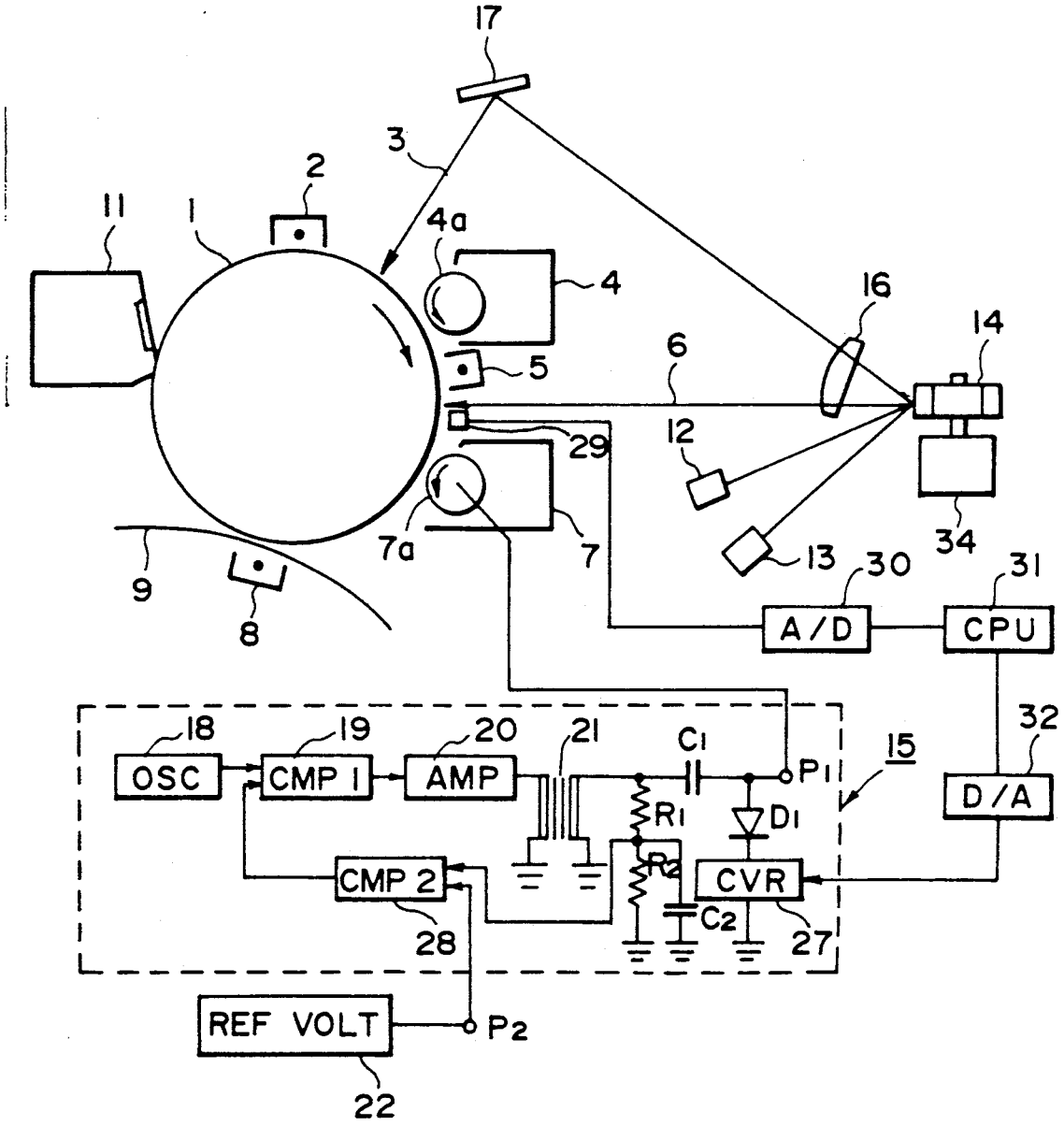
FIG. 7 shows an arrangement of an image forming apparatus according to another embodiment of the present invention.

FIG. 7 shows an image forming apparatus according to another embodiment of the present invention. The image forming apparatus according to this embodiment includes, in addition to the elements of the image forming apparatus shown in FIG. 2, a potential sensor 29 for detecting the drum surface potential after it is charged by the second charger 5, and an A/D transducer 30, D/A transducer 32 and a microcomputer (CPU) 31. In this structure, a signal level of the surface potential VT of the first toner image on the photosensitive drum 1, produced by the potential sensor 29 is converted to a digital signal by the A/D transducer 30. The CPU 31 calculates, in response to the digital signal, the voltage VA2 to make constant |VT−VA2|, that is, the strength of the electric field for urging the toner of the first toner image to the sleeve *7a*, and produces a driving instruction signal to the constant voltage source 27 through the D/A converter 32 in accordance with the calculation. By doing so, the mixture of the toner can be prevented even if the surface potential of the photosensitive drum 1 changes.

Figure 8:
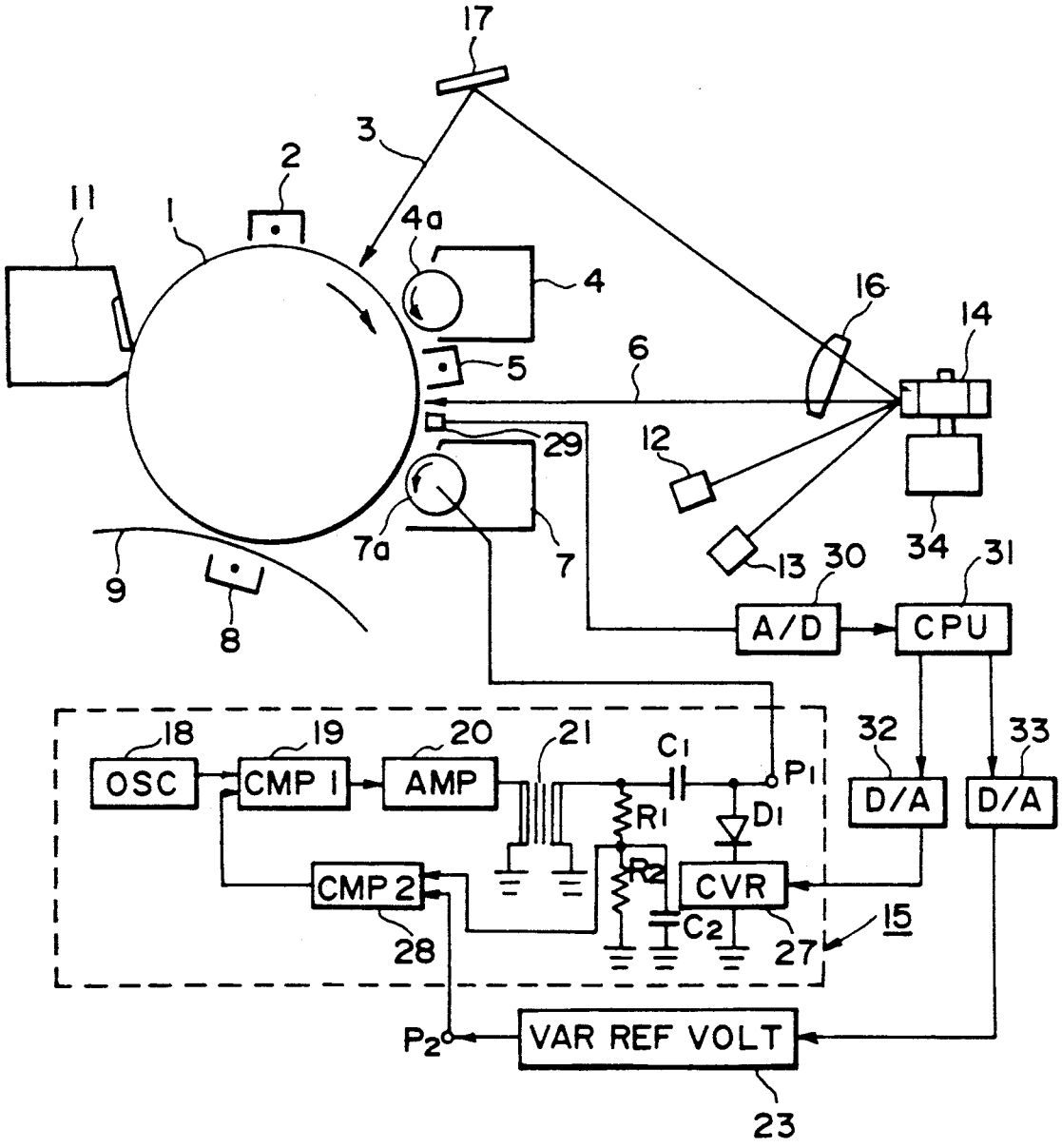
FIG. 8 shows an arrangement of an image forming apparatus according to a further embodiment.

FIG. 8 shows an image forming apparatus according to a further embodiment of the present invention. The image forming apparatus of this embodiment includes, in addition to the elements shown in FIG. 7, a D/A converter 33. In this image forming apparatus, a signal level of the light portion potential VL of the second latent image formed on the photosensitive drum, produced by the potential sensor 29 is converted to a digital signal by the A/D converter 30. The CPU 31 calculates a level of the voltage $\overline{VDC}$ to make substantially constant |VDC−VL|, that is, the strength of the electric field for urging the toner from the light potential portion of the second latent image from the sleeve, in accordance with the digital signal. On the basis of the calculation, a signal is supplied to the variable reference voltage source 23 to the D/A converter. By this, the mixture of the toner can be prevented even when the surface potential of the photosensitive drum 1 changes, and in addition, the variation of the image density of the copy image can be prevented. In the embodiments of FIGS. 7 and 8, it is a possible alternative that a first toner image and a second electrostatic latent image for measurement rather than for the printing, are formed, and the potential of such a sample image is measured by the sensor 29.

In the following description of the embodiments, only the circuit diagrams are shown. The same reference numerals are assigned to the elements having the corresponding functions as in FIG. 2.

Figure 9:
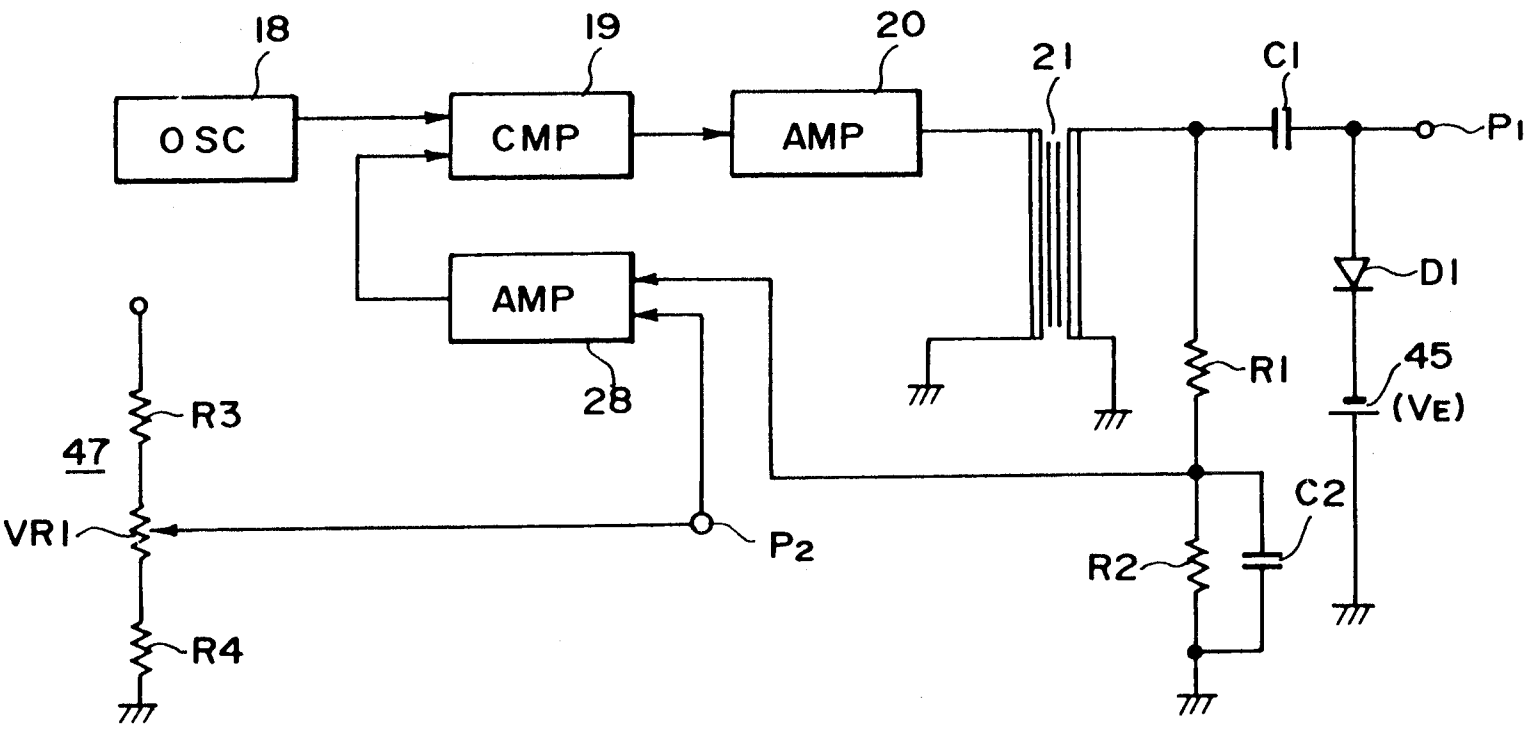
FIG. 9 illustrates a yet further embodiment of the present invention.
Figure 10B:
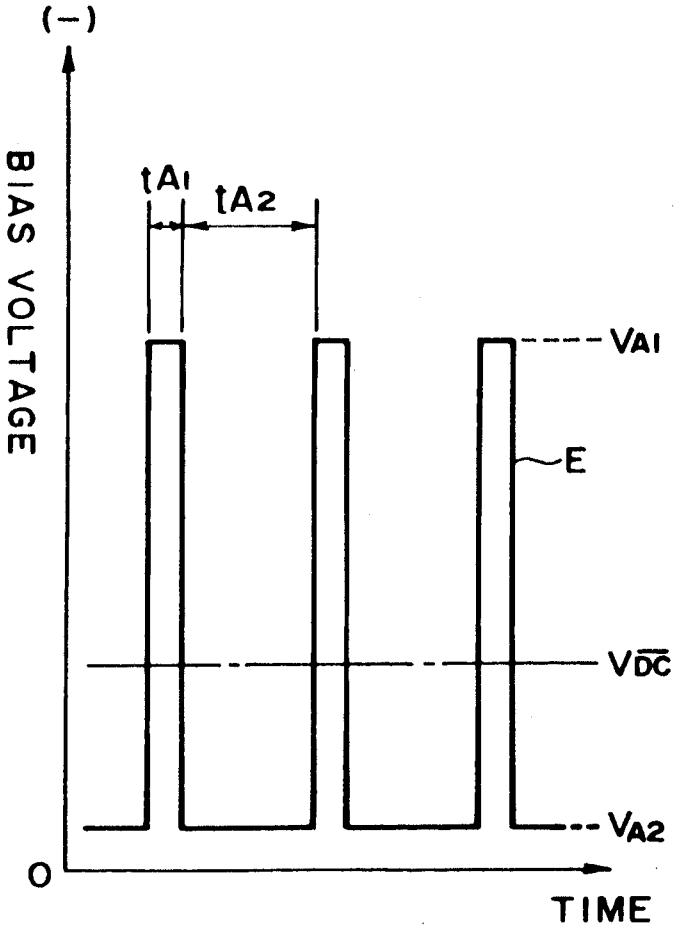
FIGS. 10A and 10B show a vibratory bias voltage waveform.
Figure 10A:
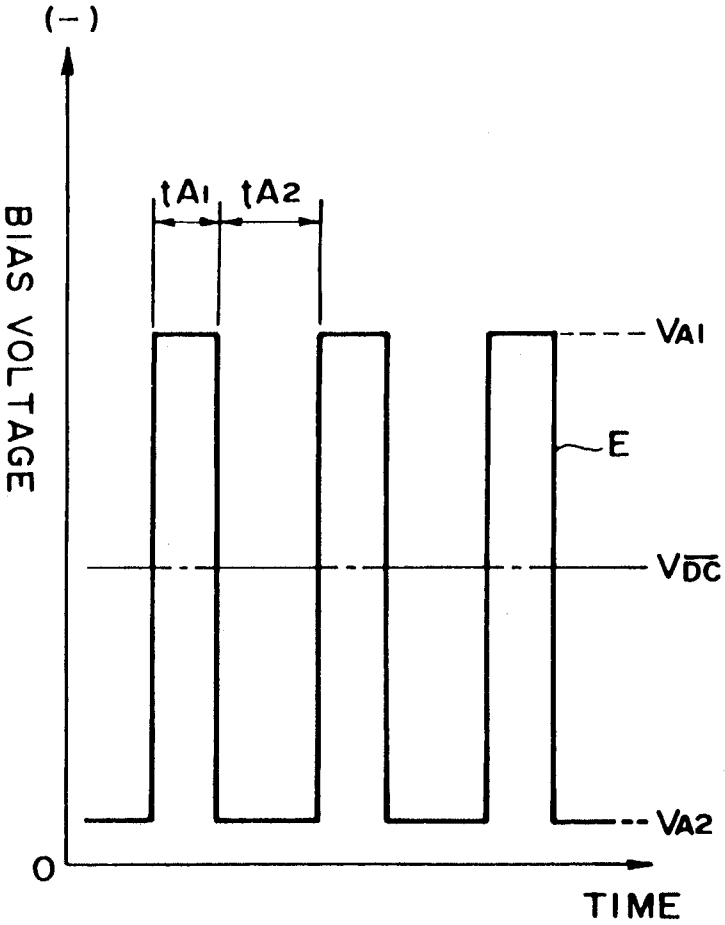

FIG. 9 shows a bias circuit. In this circuit, an operator can selectively apply a rectangular wave, for example, having different duty ratios FIG. 7 (*a*) and (*b*) to the developing sleeve *7a*, in the manner which will be described hereinafter. Then, the image density and the line width of the second toner can be adjusted so that the equation (1) is satisfied, and the foggy background of the second developed image can be prevented. The circuit of FIG. 9 embodiment is provided with an image quality adjusting means 47 having a variable resistor VR1 for permitting the operator to manually select the image quality. The amplifier 28 compares the integration VDC of the vibrator voltage actually applied to the sleeve *7a* and a voltage level signal (a signal corresponding to the target integration) corresponding to the variable image density produced by the image quality adjusting means 47 constituted by the resistors R3 and R4 and a variable resistor VR1, and it amplifies the difference therebetween and applies it to the comparator 19. By doing so, the integration of the vibration voltage applied to the sleeve *7a* is substantially maintained at the target integration level. The integration level of the vibrating bias voltage can be manually changed by the image adjusting means 47, in response to which the duty ratio changes as shown in FIG. 10 which will be explained in detail hereinafter. At this time, the minimum and maximum levels VA1 and VA2 of the vibrating bias voltage do not change. The maximum level VA2 is determined in response to the voltage VE ,of the voltage source 45.

FIGS. 10(*a*) and 10(*b*) show the developing bias to explain the operation of the circuit of FIG. 9, and the ordinate represents the bias voltage, and the abscissa represent time.

In FIG. 7, VA2 represents the maximum level (−100 V) of the vibrating bias voltage E, and VA1 represents the minimum level (−1300 V) of the vibrating bias voltage E. The frequency of oscillation is 1600 Hz. In FIG. 7(*a*), the integration $\overline{VDC}$ is −600 V. The duty ratio $t_{A1}:t_{A2}=4.2:5.8$.

In FIG. 7(*b*), the integration VDC is −400 V, and the duty ratio $t_{A1}:t_{A2}=2.5:7.5$.

When the image qualities were observed with the integration level being changed in the range between −350−−650 V, the results were shown in the following Table 1. The measuring conditions, the measuring devices and the latent image forming conditions were the same as described hereinbefore.

TABLE 1

| Integration level | Fog | Toner mixture | Image density | Line width (μm) |
|---|---|---|---|---|
| −350 | Slight | None | 0.9 | 120 |
| −400 | None | None | 1.1 | 140 |
| −450 | None | None | 1.2 | 170 |
| −500 | None | None | 1.3 | 220 |
| −550 | None | None | 1.4 | 280 |
| −600 | None | None | 1.4 | 330 |
| −650 | Slight | None | 1.4 | 370 |

As will be understood by changing the target integration level of the vibratory bias voltage by the image adjusting means 47, and by controlling the duty ratio of the vibratory bias voltage in response to the change, the image density and the line width can be adjusted within a sufficiently wide range without the toner mixture into the second developing device 7 and without the production of the foggy background. This is because, the minimum and maximum peak levels VA1 and VA2 of the vibratory bias voltage even if the integration $\overline{VDC}$ is changed, more particularly, for example, the strength of the foggy background producing electric field (|VA1−VD|/d) for moving the toner from the developing sleeve 7*a* to the dark potential portion of the photosensitive member 1 does not change, and the strength of the electric field (|VA2−VT|/d) for transferring the toner or the like is transferred from the photosensitive member 1 to the developing sleeve 7*a* does not change, either.

In order to obtain the above advantage, it is preferable that the developing bias is so controlled that the image portion potential VL of the second toner image, the image portion potential VT of the first toner image and the integration level $\overline{VDC}$ satisfy the above given equations (1)–(3), or (4)–(6).

Figure 11:
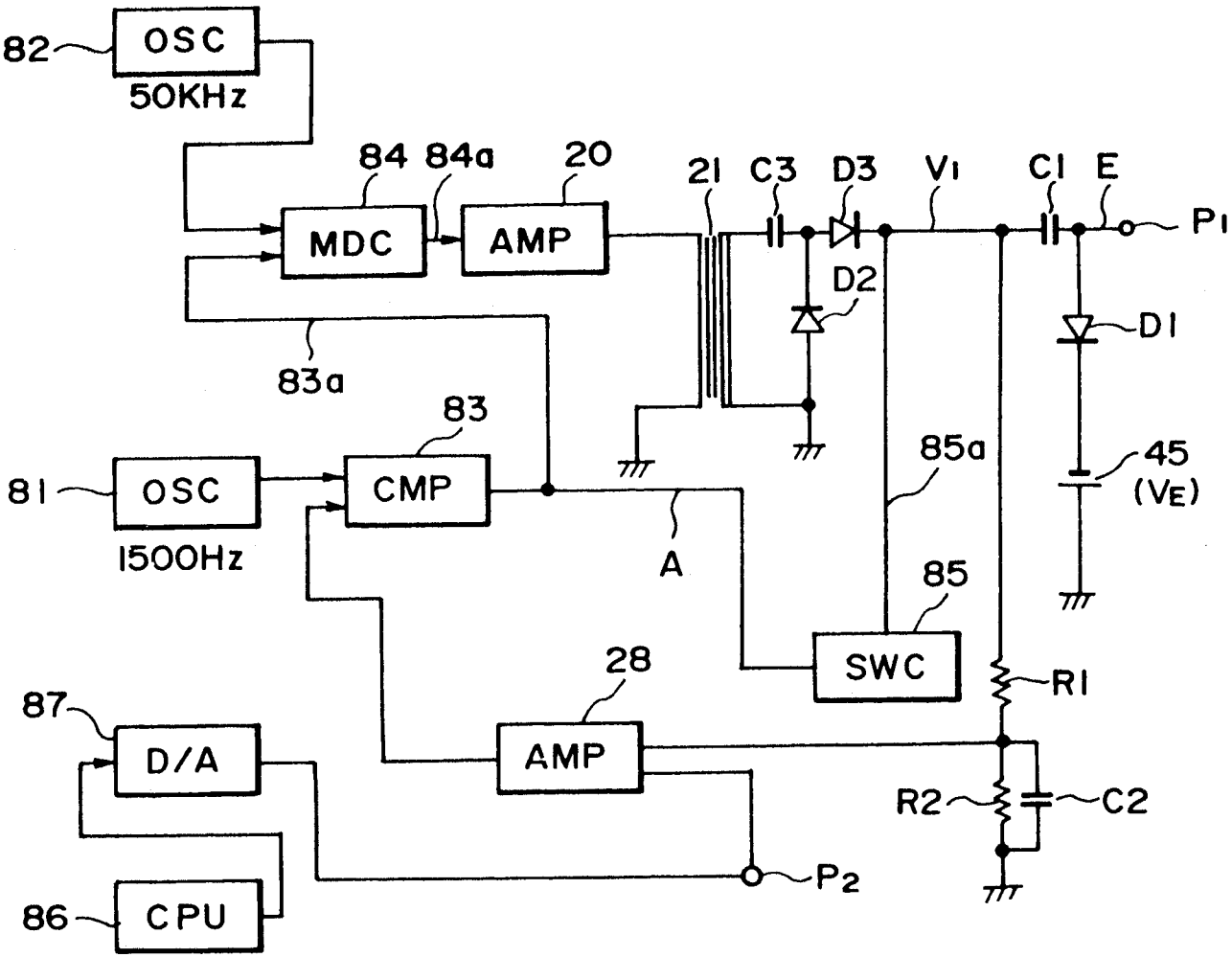
FIG. 11 illustrates a yet further embodiment present invention.
Figure 12A:
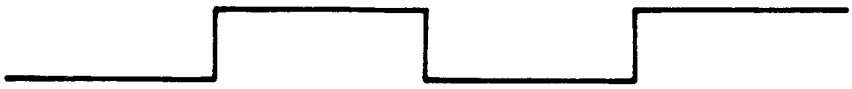
FIGS. 12*a*)–12(*f*) show voltage waveform in the embodiment of FIG. 11.
Figure 12B:
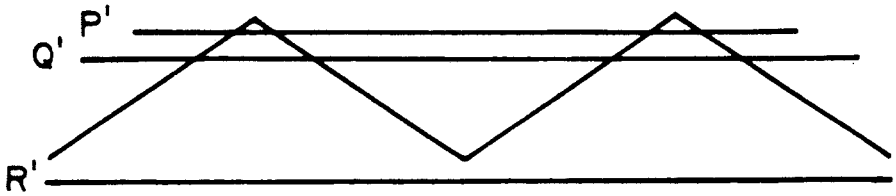
Figure 12C:
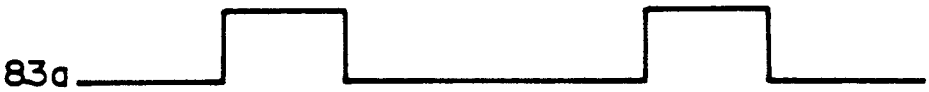
Figure 12D:
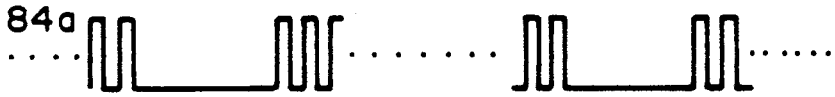
Figure 12E:
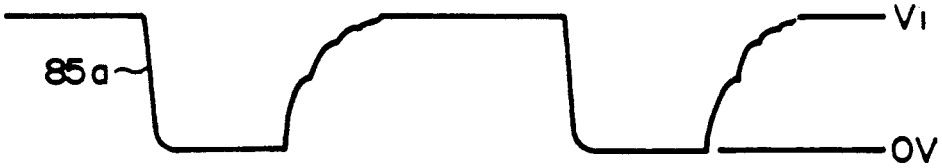
Figure 12F:
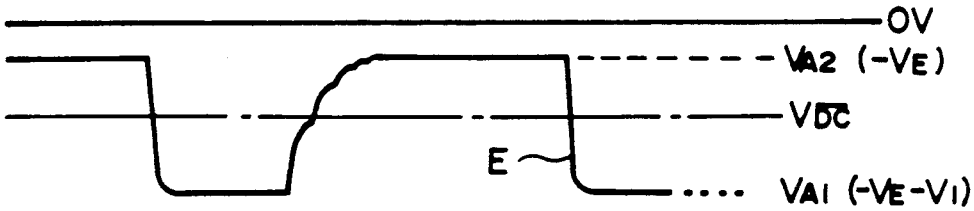

FIG. 11 is a block diagram of a developing bias source circuit of a multi-color image forming apparatus according to a further embodiment.

It comprises oscillation circuits (OSC) 81 and 82. The oscillation circuit 81 produces a rectangular wave (duty ratio is 1:1) having a frequency of 1500 Hz as shown in FIG. 12(*a*) to a modulation circuit (comparator) 83, and the oscillation circuit 82 produces a rectangular wave (duty ratio is 1:1) having a frequency of 50 KHz shown in FIG. 12(*b*) to a modulation circuit 84. The circuit further comprises a comparator (CMP) 83 which compares the output of an error amplifier 28 and the rectangular wave of 1500 Hz produced by the oscillation circuit (OSC) 81, and it supplies the difference therebetween to the modulation circuit 84. A switching circuit (SWC) 85 is closed when the output of the comparator 83 is at H-level, and at this time, a converter transformer 21 and the amplifier 28 are isolated.

A microcomputer (CPU) 86 sets a required integration level $\overline{VDC}$ of the vibratory bias voltage to the error amplifier 28 through a D/A converter 87. The circuit includes a capacitor C3 and diodes D2 and D3.

FIGS. 12(*a*)–12(*f*) show a voltage waveform for illustrating the operation of various parts of FIG. 11. FIG. 12(*a*) shows the rectangular waveform of 1500 Hz produced by the oscillation circuit 82; FIG. 12(*b*) shows a rectangular wave of 50 KHz produced by the oscillation circuit 81; FIG. 12(*c*) shows an output 83*a* of the comparator 83; FIG. 12(*d*) shows an output 84*a* of the modulation circuit 84; FIG. 12(*e*) shows an output 85*a* of the switching circuit 85; and FIG. 12(*f*) shows an output (a vibratory bias voltage E) at the outlet port P1. It is added here that the converter transformer 44 is of a high frequency drive type, and therefore, the size thereof can be reduced.

When the oscillation circuit 81 produces to the modulation circuit 84 the rectangular wave having the duty ratio of 1:1 and the frequency of 1500 Hz shown in FIG. 12(*a*), the modulation circuit 84 modulates the rectangular wave in accordance with the output 83*a* from the comparator 83.

On the other hand, the switching circuit 85 is closed when the output 83*a* of the comparator 83 is at H-level, so that the converter transformer 21 and the amplifier 20 are isolated. Therefore, a voltage V1 is provided at the cathode side of the diode D3 while the switching circuit 85 is operated at the frequency of 50 KHz, and it is smoothed by the cramping capacitor C3 and the load capacity. Therefore, the output 85*a* of the switching circuit 85 is as shown in FIG. 12(*e*). The produced output 85*a* is supplied to the output port P1 by the cramping capacitor C1. The diode D1 is rendered conductive at the forward peak. However, it is cramped by the voltage source 45 (potential is VE) and therefore, an output having an amplitude of V1, minimum peak level of VA1 (−VE-V1) and a maximum level (VA2) of −VE is produced at the output port P1. The output 85*a* of the switching circuit 85 is smoothed and divided in the voltage by a predetermined ratio by a smoothing circuit constituted by the resistors R1 and R2 and a capacitor C2. Thereafter an average level thereof is supplied to the error amplifier 28.

The error amplifier 28 is responsive to the voltage level and the digital data produced by the CPU 86 to amplify a difference from an integration $\overline{VDC}$ of the vibrator bias voltage produced by the D/A converter 87, and the resultant signal level (P', Q', R' or the like). The comparator 83 compares the output of the oscillator 81 and the output of the error amplifier 28, and produces a pulse-width-modulated output (PWM), for example the control signal A (output 83*a*) shown in FIG. 12(*c*). In response to the control signal A, the switching circuit 85 is driven, and the signal is supplied to the modulation circuit 84, by which the output of the oscillation circuit 82 is modulated as shown in FIG. 12(*d*). It is, then, supplied to the converter transformer 21 through the amplifier 20. In this manner, the vibratory voltage E (FIG. 12(*f*)) applied to the sleeve 7*a* of the second developing device, is provided.

As shown in FIG. 12(*f*), the vibratory bias voltage (developing bias) E is not completely rectangular particularly at the rising portion of the pulse. However, since the integration $\overline{VDC}$ of the developing bias E is controlled to be constant, the same quality images can be provided with the same developing bias conditions irrespective of the waveform, by employing a system wherein the duty ratio is changed.

Even if the waveform of the developing bias E changes more or less, the image can be stabilized at all times because the integration $\overline{VDC}$ of the developing bias E most relevant to the image quality is controlled to be substantially constant. Thus, the image quality can be sufficiently stabilized and assured even if the waveform of the developing bias E changes due to variation in the load of the second developing device 7, or the variation in the developing bias waveform due to the variation in the individual developing bias voltage sources.

In this embodiment, since the integration level of the developing bias E is changed through the CPU 86, the integration level of the developing bias E can be changed in response to the steps of the control sequence such as the pre-rotation before the image formation on the drum or a post rotation after the image formation or the interval between an image formation and a subsequent image formation in an electrophotographic copying apparatus.

Figures 13A, 13B:
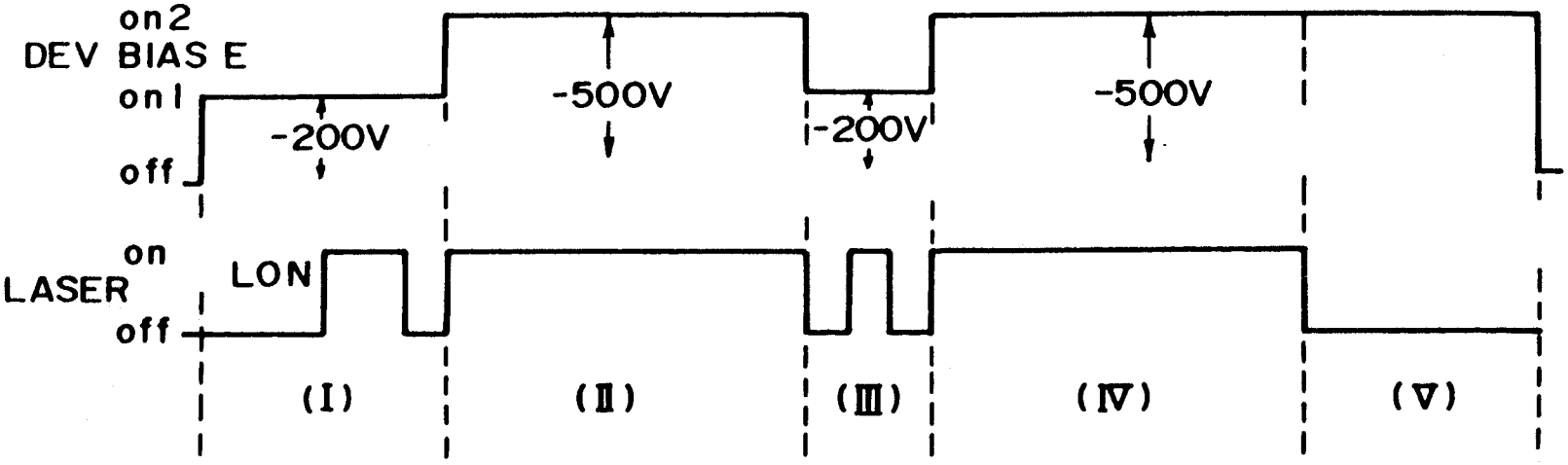
FIGS 13(*a*) and 13(*b*) show an example of an operational sequence.

Referring to FIGS. 13(*a*) and 13(*b*) an example of this type will be described. FIG. 13 is a timing chart illustrating the developing bias control in accordance with an electrophotographic process. In these Figures, reference LON indicates a laser beam emitting signal; I indicates the pre-rotation period before the start of the image formation; II and IV indicate printing periods (image formation period); III indicates an interval between one printing period and a subsequent printing period; and V designates a post-rotation period after the completion of the image formation.

During the period I, the laser beam emitting signal LON becomes high so as to permit the control of the quantity of light of the laser beam for forming the second image. At this time, in order to prevent the toner in the second developing device 7 from being consumed, the integration level $\overline{VDC}$ of the developing bias E applied to the second developing device 7 is maintained at high as possible level (-200 V in this embodiment).

During the printing periods II and IV, the integration level $\overline{VDC}$ of the developing bias E is changed to −500 V so that an optimum multi-color image can be provided.

During the period III, the integration level of the developing bias E increased to −200 V for the same reason as in the period I (light amount control).

During the period V, the light amount control is not effected, so that the integration level of the developing bias E is maintained at −500 V.

Therefore, even if the quantity of laser light is controlled, the first color toner is prevented from mixing into the second developing device 7, and in addition, in the next image formation, a multi-color print is possible with sufficient sharpness, image density and reproducibility.

Furthermore, the operator can manually set the target integration level by the CPU 86 in accordance with the image quality desired by the operator.

Figure 14:
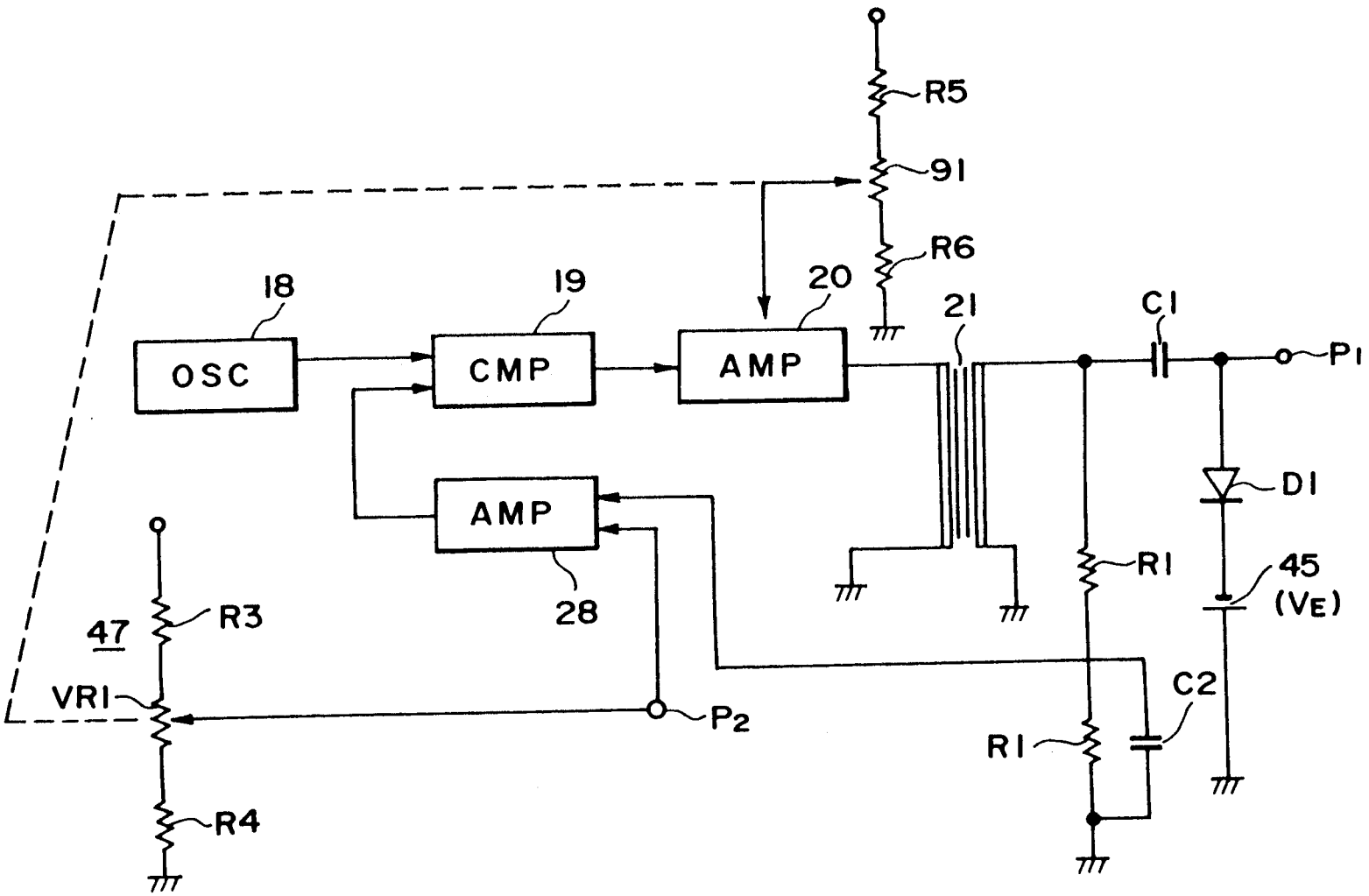
FIG. 14 illustrates a yet further embodiment of the present invention.

Referring to FIG. 14, an embodiment of this type will be described. FIG. 14 is a block diagram illustrating the developing bias circuit for a multicolor image forming apparatus of this embodiment. The same reference numerals as in FIG. 2 are assigned to the elements having the corresponding functions. The circuit includes a variable resistor 91 to control a gain of the amplifier 20 to adjust the minimum level VA1 of the bias voltage E. The variable resistor 91 is operated manually by an operator in association with the image adjusting means 47. It controls the amplitude of the input signal to the converter transformer 21 to change the minimum level VA1.

Figure 15B:
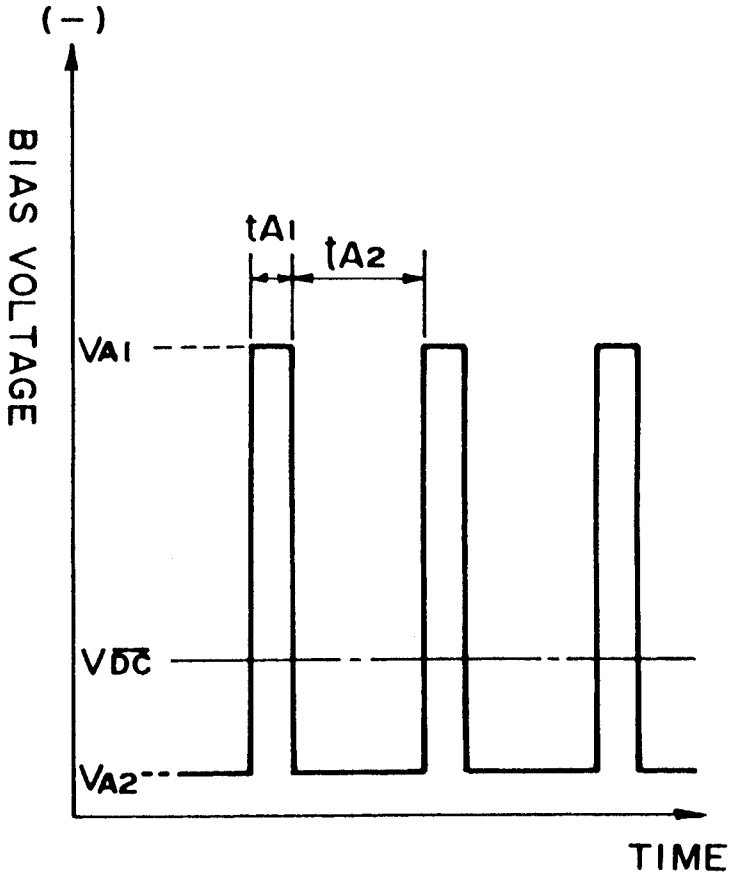
FIGS. 15A and 15B show a vibratory bias voltage in the embodiment of FIG. 14.
Figure 15A:
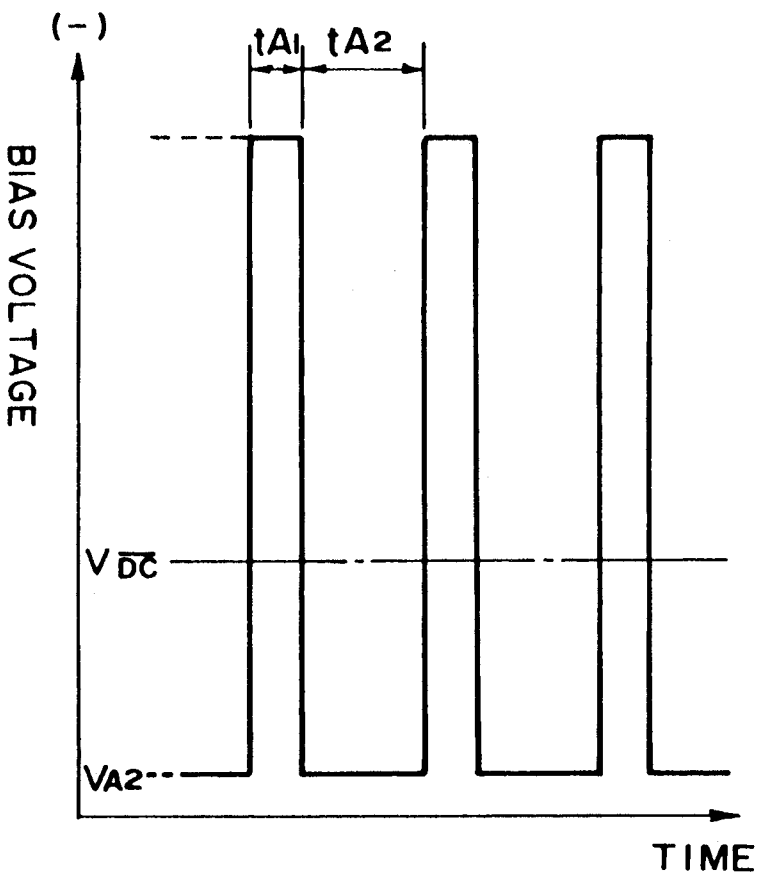

Referring to FIGS. 15(*a*) and 15(*b*), the operation of the circuit shown in FIG. 14 will be described. FIGS. 15(*a*) and 15(*b*) the developing bias voltage produced by the circuit of FIG. 14. FIG. 15(*a*) shows a vibrating bias voltage E1 which is provided when the minimum level is −1500 V, the maximum level VA2 is −100 V, the frequency is 1500 Hz, the duty ratio $t_{A1}:t_{A2}$ is 2.9:7.1, and the integration $\overline{VDC}$ is −500 V.

FIG. 15(*b*) shows a vibratory bias voltage E2, which is provided when the minimum level VA1 is −1000 V, the maximum level VA2 is −100 V, the frequency is 1500 Hz, the duty ratio $t_{A1}:t_{A2}$ is 1.7:8.3, and the integration $\overline{VDC}$ is −250 V.

When only the duty ratio is changed in order to provide the desired integration level of the developing bias E, the duty ratio is 1.1:8.9 to provide the integration level $\overline{VDC}$ of −250 V under the condition that the minimum level VA1 of the bias voltage E is −1500 V. Then, the steep rising is required to the developing bias waveform. If the rising becomes dull due to load variation or the like of the developing bias E, the control becomes not possible with the result that it is difficult to provide wide variable range of the integration level, so that the minimum level VA1 of the bias voltage E can not be reduced. Thus, it becomes difficult that the difference from the image portion potential VL is made large. When the variable resistor VR1 is changed to change the integration level, the gain of the amplifier 20 is changed in accordance with the variable resistor 91 change, by which the integration level can be sufficiently made larger, while the minimum level VA1 of the bias voltage E can be reduced. Therefore, an image having good reproducibility of the thin line can be provided, and in addition the variable range of the line width can be made wider.

At this time, the maximum level VA2 of the vibratory bias voltage E is fixed by the voltage source 45, and therefore, the toner of the first color is prevented from mixing into the second developing device 7.

In the foregoing embodiment, the description has been made with respect to the image forming apparatus capable of producing a two color image, but the present invention is applicable to an electrophotographic apparatus capable of producing three or more color image. Furthermore, the present invention is applicable to an electrostatic recording apparatus of a multi-stylus type or the like. Also, the usable colors are not limited to the red and black.

In the foregoing embodiments, the laser beam is modulated in accordance with a signal indicative of the image to be recorded. However, it is also possible that the light image to which the photosensitive member is exposed can be provided by an array of light emitting diodes, an array of liquid crystal shutter or the like driven in accordance with information signal.

In the foregoing embodiments, the waveform of the developing bias is rectangular. However, it is not limiting, and a triangular wave or sine wave form are usable. The waveform may be any if pulse width modulation (PWM) is possible.

The usable developers are not limited, and may be a two component developer, one component magnetic developer and one component non-magnetic developer.

In the foregoing, the toner is negatively charged, but, the present invention is applicable to an image forming apparatus using a positively charged toner. In such a case, the voltage level VA1 and the voltage level VA2 are interchanged, in the foregoing descriptions.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member;

latent image forming means for forming first and second electrostatic latent images on said image bearing member;

first developing mean for forming a first visualized image by developing the first electrostatic latent image;

second developing means for providing a second visualized image by developing the second electrostatic latent image, wherein said second developing means acts on said image bearing member after the first visualized image is formed on said image bearing member, and wherein said second developing means includes developer carrying means for carrying a developer to a developing position where the developer is supplied to said image bearing member;

means for applying a vibratory voltage to said developer carrying means of said second developing means; and control means for changing a duty ratio of the vibratory voltage, wherein the vibratory voltage has a first peak for forming an electric field to urge the developer away from said developing carrying means toward said image bearing member and a second peak for forming an electric field to urge the developer away from said image bearing member toward said developer carrying means, wherein the first peak and second peak are alternately applied, wherein said control means changes a duty ratio while maintaining the second peak substantially constant, and wherein said control means changes the duty ratio by changing the first peak.

2. An apparatus according to any one of claim 1, wherein said control means includes manually operable means, in response to which the duty ratio is changed to change an integration level of the vibratory voltage.

3. An apparatus according to claim 2, wherein a minimum clearance at the developing position between said developer carrying means of said second developing means and said image bearing member is larger than a thickness of a layer of the developer carried on said developer carrying means.

4. An image forming apparatus comprising:

a movable image bearing member;

latent image forming means for forming first and second electrostatic latent images on said image bearing member;

first developing means for forming a first visualized image by developing the first electrostatic latent image;

second developing means for providing a second visualized image by developing the second electrostatic latent image, wherein said second developing means acts on said image bearing member after the first visualized image is formed on said image bearing member, and wherein said second developing means includes developer carrying means for carrying a developer to a developing position where the developer is supplied to said image bearing member;

means for applying a vibratory voltage to said developer carrying means of said second developing means; and control means for changing a duty ratio of the vibratory voltage, wherein the vibratory voltage has a first peak for forming an electric field to urge the developer away from said developing carrying means toward said image bearing member and a second peak for forming an electric field to urge the developer away from said image bearing member toward said developer carrying means, wherein the first peak and second peak are alternately applied, wherein said control means changes the duty ratio while maintaining the second peak substantially constant, and wherein said control means changes the duty ratio while maintaining an integration value of the vibratory voltage substantially constant.

5. An apparatus according to claim 4, further comprising detecting means for detecting a potential of the first visualized image, and said control means changes the second peak in accordance with an output of said detecting means.

6. An apparatus according to claim 4 or 5, further comprising latent image potential detecting means for detecting a potential of such a portion of second latent image as to be visualized, wherein said control means changes the integration in accordance with an output signal from said latent image potential detecting means.

7. An apparatus according to claim 6, wherein a minimum clearance at the developing position between said developer carrying means of said second developing means and said image bearing member is larger than a thickness of a layer of the developer carried on said developer carrying means.

8. An image forming apparatus comprising:

a movable image bearing member;

latent image forming means for forming first and second electrostatic latent images on said image bearing member;

first developing means for forming a first visualized image by developing the first electrostatic latent image;

second developing means for providing a second visualized image by developing the second electrostatic latent image, wherein said second developing means acts on said image bearing member after the first visualized image is formed on said image bearing member, and wherein said second developing means includes developer carrying means for carrying a developer to a developing position where the developer is supplied to said image bearing member;

means for applying a vibratory voltage to said developer carrying means of said second developing means;

control means for changing a duty ratio of the vibratory voltage, wherein the vibratory voltage has a first peak for forming an electric field to urge the developer away from said developing carrying means toward said image bearing member and a second peak for forming an electric field to urge the developer away form said image bearing member toward said developer carrying means, and wherein the first peak and second peak are alternately applied; and detecting means for detecting a potential of the first latent image, wherein said control means changes the second peak in accordance with an output of said detecting means.

9. A image forming apparatus comprising:

a movable image bearing member;

latent image forming means for forming first and second electrostatic latent images on said image bearing member;

first developing means for forming a first visualized image by developing the first electrostatic latent image;

second developing means for providing a second visualized image by developing the second electrostatic latent image, wherein said second developing means acts on said image bearing member after the first visualized image is formed on said image bearing member, and wherein said second developing means includes developer carrying means for carrying a developer to a developing position where the developer is supplied to said image bearing member;

means for applying a vibratory voltage to said developer carrying means of sad second developing means;

control means for changing a duty ratio of the vibratory voltage, wherein the vibratory voltage has a first peak for forming an electric field to urge the developer away from said developing carrying means toward said image bearing member and a second peak for forming an electric field to urge the developer away from said image bearing member toward said developer carrying means, and wherein the first peak and second peak are alternately applied; and latent image potential detecting means for detecting a potential of such a portion of the second latent image as to be visualized, wherein said control means changes an integration value of the vibratory voltage in accordance with an output of said latent image potential detecting means.

10. An apparatus according to claim 4, 5, 8 or 9, wherein a minimum clearance at the developing position between said developer carrying means of said second developing means and said image bearing member is larger than a thickness of a layer of the developer carried on said developer carrying means.

11. An image forming apparatus, comprising:

a movable image bearing member;

a first charger for electrically charging said image bearing member in a predetermined polarity;

first exposure means for exposing said image bearing member having been charged by said first charger with first image information light to form a first electrostatic latent image;

first developing means for developing the first electrostatic latent image of a first color toner electrically charged to form a first visualized image;

a second charger for electrically charging said image bearing member having the first visualized image with the same polarity as the predetermined polarity;

second exposure means for exposing said image bearing member charged by said second charger to second information light to form a second electrostatic latent image;

second developing means actable on said image bearing member having the first visualized image and the second electrostatic latent image to develop the second latent image to form a second visualized image, said second developing means including a developer carrying member for carrying a second color toner electrically charged having the same polarity as the first color toner to supply in a developing position the second color toner to said image bearing member;

means for applying a vibratory voltage to the developer carrying member of said second developing means, wherein the vibratory voltage has a first peak for forming an electric field to urge the toner away from the developer carrying member toward said image bearing member and a second peak for forming an electric field to urge the toner away from said image bearing member toward said developer carrying member, and wherein the first peak and the second peak are alternately applied; and control means for changing a duty ratio of the vibratory voltage, wherein an integration value of the vibratory voltage is between a potential of the first visualized image charged by said second charger and a potential of such a portion of the second electrostatic latent image as to be visualized, wherein said first and second exposure means expose said image bearing member at portions which are to receive the toners, and wherein said first and second developing means reverse-develop the first and second latent images with the toners which are charged to the predetermined polarity.

12. An apparatus according to claim 11, wherein a minimum clearance at the developing position between said developer carrying means of said second developing means and said image bearing member is larger than a thickness of a layer of the developer carried on said developer carrying means.

13. An apparatus according to claim 12, wherein said control means changes the duty ratio while maintaining the first peak and the second peak substantially constant.

14. An apparatus according to claim 12, wherein said control means changes the duty ratio while maintaining the second peak substantially constant.

15. An apparatus according to claim 14, wherein said control means changes the duty ratio, and changes the first peak.

16. An apparatus according to claim 14, wherein said control means changes the duty ratio while maintaining the integration value of the vibratory voltage substantially constant.

17. An apparatus according to claim 16, further comprising detecting means for detecting a potential of the first visualized image charged by said second charger, wherein said control means changes the second peak in accordance with an output of said detecting means.

18. An apparatus according to claim 16 or 17, further comprising latent image potential detecting means for detecting a potential of such a portion of the second latent image as to be visualized, wherein said control means changes the integration in accordance with an output of said latent image potential detecting means.

19. An apparatus according to claim 11, further comprising detecting means for detecting a potential of the first visualized image, wherein said control means changes the second peak in accordance with an output of said detecting means.

20. An image forming apparatus comprising:

a movable image bearing member;

a first charger for electrically charging said image bearing member with a predetermined polarity;

first exposure means for exposing said image bearing member charged by said first charger with first image information light to form a first electrostatic latent image;

first developing means for developing the first electrostatic latent image of a first color toner electrically charged to form a first visualized image;

a second charger for electrically charging said image bearing member having the first visualized image with the same polarity;

second exposure means for exposing said image bearing member charged by said second charger with second information light to form a second electrostatic latent image;

second developing means actable on said image bearing member having the first visualized image and the second electrostatic latent image to develop the second latent image to form a second visualized image, said second developing means including a developer carrying member for carrying a second color toner electrically charged with the same polarity as the first color toner to supply in a developing position the second color toner to said image bearing member;

means for applying a vibratory voltage to said developer carrying member of said second developing means, wherein the vibratory voltage has a first peak for forming an electric field to urge the toner away from said developer carrying member toward said image bearing member and a second peak for forming an electric field to urge the toner away from said image bearing member toward said developer carrying member, and wherein the first peak and the second peak are alternately applied; and control means for changing a duty ratio of the vibratory voltage, wherein an integration value of the vibratory voltage is between a potential of the first visualized image charged by said second charger and a potential of such a portion of the second electrostatic latent image as to be visualized.

21. An apparatus according to claim 20, wherein said control means includes manually operable means, in response to which the duty ratio is changed to change an integration level of the vibratory voltage.

22. An apparatus according to claim 20, further comprising latent image potential detecting means for detecting a potential of such a portion of the second latent image as to be visualized, wherein said control means changes an integration of the vibratory voltage in accordance with an output of said latent image potential detecting means.

23. An image forming apparatus, comprising:

a movable image bearing member;

latent image forming means for forming first and second electrostatic latent images on said image bearing member;

first developing means for forming a first visualized image by developing the first electrostatic latent image;

second developing means for providing a second visualized image by developing the second electrostatic latent image, wherein said second developing means acts on said image bearing member after the first visualized image is formed on said image bearing member, and wherein said second developing means comprises developer carrying means for carrying a developer to a developing position where the developer is supplied to said image bearing member;

means for applying a vibratory voltage to said developer carrying means of said second developing means; and control means for changing a duty ratio of the vibratory voltage; and wherein an integration value of the vibratory voltage is between a potential of the first visualized image and a potential of such a portion of the second electrostatic latent image as to be visualized.

24. An image forming apparatus, comprising:

a moving image bearing member;

a first charger for electrically charging said image bearing member a predetermined polarity;

first exposure means for exposing said image bearing member having been charged by said first charger with first image information light to form a first electrostatic latent image;

first developing means for developing the first electrostatic latent image for a first color toner electrically charged to form a first visualized image;

a second charger for electrically charging said image bearing member having the first visualized image with the same polarity as the predetermined polarity;

second exposure means for exposing said image bearing member charged by said second charger with second information light to form a second electrostatic latent image;

second developing means actable on said image bearing member having the first visualized image and the second electrostatic latent image to develop the second latent image to form a second visualized image, said second developing means including a developer carrying member for carrying a second color toner electrically charged having the same polarity as the first color toner to supply in a developing position a second color toner to said image bearing member;

means for applying a vibratory voltage to the developer carrying member of said second developing means; and control means for changing a duty ratio of the vibratory voltage, wherein an integration value of the vibratory voltage is between a potential of the first visualized image charged by said second charger and a potential of such a portion of the second electrostatic latent image as to be visualized.

25. An image forming apparatus, comprising:

a movable image bearing member;

latent image forming means for forming first and second electrostatic latent images on said image bearing member;

first developing means for forming a first visualized image by developing the first electrostatic latent image;

second developing means for providing a second visualized image by developing the second electrostatic latent image, wherein said second developing means acts on said image bearing member after the first visualized image is formed on said image bearing member, and wherein said second developing means includes developer carrying means for carrying a developer to a developing position where the developer is supplied to said image bearing member;

means for applying a vibratory voltage to said developer carrying means of said second developing means, wherein the vibratory voltage has a first peak for forming a first electric field and a second peak for forming a second electric field to apply a force to a toner of the first visualized image in a direction away from said image bearing member toward said developer carrying means, and wherein the first peak and second peak are alternately applied; and control means for changing a duty ratio of the vibratory voltage while maintaining a difference of a potential of the first visualized image and the second peak substantially constant.

26. An apparatus according to claim 25, wherein an integration value of the vibratory voltage is between the potential of the first visualized image and a potential of such a portion of the second electrostatic latent image as to be visualized.

27. An image forming apparatus, comprising:

a movable image bearing member;

a first charger for electrically charging said image bearing member having a predetermined polarity;

first exposure means for exposing said image bearing member having been charged by said first charger with first image information light to form a first electrostatic latent image;

first developing means for developing the first electrostatic latent image of a first visualized image;

a second charger for electrically charging said image bearing member having the first visualized image with the same polarity as the predetermined polarity;

second exposure means for exposing said image bearing member charged by said second charger with second information light to form a second electrostatic latent image;

second developing means actable on said image bearing member having the first visualized image and the second electrostatic latent image to develop the second latent image to form a second visualized image, said second developing means including a developer carrying member for carrying a second color toner electrically charged having the same polarity as the first color toner to supply in a developing position the second color toner to said image bearing member;

means for applying a vibratory voltage to the developer carrying member of said second developing means, wherein the vibratory voltage has a first peak for forming an first electric field and a second peak for forming an second electric field to apply a force to a toner of the first visualized image in a direction away from said image bearing member toward said developer carrying member, and wherein the first peak and the second peak are alternately applied; and control means for changing a duty ratio of the vibratory voltage while maintaining a difference of a potential of the first visualized image charged by said second charger and the second peak substantially constant.

28. An apparatus according to claim 27, wherein an integration value of the vibratory voltage is between the potential of the first visualized image charged by said second charger and a potential of such a portion of the second electrostatic latent image as to be visualized.

* * * * *

UNITED STATES PATENT AND TRADEMARK OFFICE

CERTIFICATE OF CORRECTION

PATENT NO. : 5,066,979

DATED : November 19.1991

INVENTOR(S) : Masahiro Goto, et al

It is certified that error appears in the above-identified patent and that said Letters Patent is hereby corrected as shown below:

COLUMN 1

Line 23, "being ribbing" should read --rubbing--.
Line 62, "Laid-Open," should read --Laid-Open--.

COLUMN 2

Line 24, "the (frequency" should read --(the frequency--.
Line 42, "850," should read --850 V,--

COLUMN 3

Line 36, "if" should read --of--.
Line 41, "developer carrying" should read --developer away from the image bearing member toward the developer carrying--.
Line 51, "still a" should read --a still--.

COLUMN 4

Line 24, "bearing" should read --bearing member--.

COLUMN 5

Line 50, "beam 13" should read --beam 3--.

COLUMN 6

Lines 7-8, "applied developing devices of" should read --applied to the developing sleeve 4a of the first developing device 4,--.
Line 12, "consists" should read --consist--.
Line 39, "have" should read --has--.

UNITED STATES PATENT AND TRADEMARK OFFICE

CERTIFICATE OF CORRECTION

PATENT NO. : 5,066,979

DATED : November 19, 1991

INVENTOR(S) : Masahiro Goto, et al

It is certified that error appears in the above-identified patent and that said Letters Patent is hereby corrected as shown below:

COLUMN 6

Line 52, "having" should read --has--.

COLUMN 8

Line 34, "No..;" should read --No.--.

COLUMN 9

Line 11, "|L|" should read --|VL|--.

COLUMN 10

Line 51, "crumpling" should read --clamping--.

COLUMN 11

Line 12, "cramping" should read --clamping--.
Line 13, "cramped" should read --clamped--.
Line 16, "-100 V" should read -- -100 V and a--.

COLUMN 14

Line 23, "cramping" should read --clamping--.
Line 27, "cramping" should read --clamping--.
Line 28, "cramped" should read --clamped--.

COLUMN 16

Line 1, "15(b)" should read --15(b) show--.

UNITED STATES PATENT AND TRADEMARK OFFICE

CERTIFICATE OF CORRECTION

PATENT NO. : 5,066,979

DATED : November 19, 1991

INVENTOR(S) : MASAHIOR GOTO, ET AL

It is certified that error appears in the above-identified patent and that said Letters Patent is hereby corrected as shown below:

COLUMN 17

Line 31, "developing" should read --developer--.
Line 43, "any one of" should be deleted.

COLUMN 18

Line 10, "developing" should read --developer--.
Line 65, "developing" should read --developer--.
Line 68, "form" should read --from--.

COLUMN 19

Line 27, "sad" should read --said--.
Line 33, "developing" should read --developer--.

COLUMN 24

Line 22, "an" should read --a--.
Line 23, "an" should read --a--.

Signed and Sealed this

Twenty-second Day of June, 1993

*Attest:*

Michael K. Kirk

MICHAEL K. KIRK

*Attesting Officer*

*Acting Commissioner of Patents and Trademarks*